US007526906B2

(12) United States Patent
Laplace

(10) Patent No.: US 7,526,906 B2
(45) Date of Patent: May 5, 2009

(54) APPARATUS AND METHOD FOR AUTOMATED FORMING OF SLEEVES FOR SLICED PRODUCTS

(75) Inventor: Christian Laplace, Dollard des Ormeaux (CA)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 11/289,991

(22) Filed: Nov. 30, 2005

(65) Prior Publication Data

US 2006/0079385 A1 Apr. 13, 2006

Related U.S. Application Data

(62) Division of application No. 10/628,073, filed on Jul. 25, 2003, now Pat. No. 7,003,929.

(51) Int. Cl.
*B65B 9/00* (2006.01)

(52) U.S. Cl. ..... 53/551; 53/451; 493/302

(58) Field of Classification Search ..... 53/450, 53/451, 567, 575, 574, 545; 493/163, 304, 493/302, 130, 468
See application file for complete search history.

(56) References Cited

U.S. PATENT DOCUMENTS 2,940,408 A * 6/1960 Monsees, et al. ..... 29/557
3,122,072 A * 2/1964 Monsees, et al. ..... 493/468
3,415,171 A * 12/1968 Wilson ..... 493/302
3,486,424 A * 12/1969 Tanner ..... 493/468
3,494,265 A * 2/1970 Middour ..... 493/468
3,948,150 A * 4/1976 Hobart ..... 493/468
4,194,438 A * 3/1980 Schmachtel ..... 493/274
4,505,769 A * 3/1985 Auckenthaler ..... 156/217
4,517,790 A * 5/1985 Kreager ..... 53/552
4,950,345 A * 8/1990 Kreager et al. ..... 156/203
4,991,379 A * 2/1991 Boeckmann ..... 53/552
5,287,681 A * 2/1994 Vernon et al. ..... 53/550
5,707,329 A * 1/1998 Pool et al. ..... 493/302
6,131,367 A * 10/2000 Fukuda et al. ..... 53/201
6,519,917 B2 * 2/2003 Forman ..... 53/412
6,811,530 B2 * 11/2004 Watanabe et al. ..... 493/269
2002/0170273 A1 * 11/2002 Kohl et al. ..... 53/451

* cited by examiner

*Primary Examiner*—Paul R Durand
(74) *Attorney, Agent, or Firm*—Fitch, Even, Tabin & Flannery

(57) ABSTRACT

A forming apparatus is provided for forming a film into a sleeve around a filling tube. The forming apparatus has contact surface geometry that is contacted by the film as it travels thereacross configured to ensure smooth forming of the film into the sleeve. Smooth forming of the film into the sleeve is achieved, in part, by reducing longitudinal tensile forces in the film, by selecting the contact surface geometry to minimize transverse variations in tensile forces in the film, and by having contact edges of the contact surfaces shaped to reduce unnecessary stresses in the film.

11 Claims, 18 Drawing Sheets

PRIOR ART

APPARATUS AND METHOD FOR AUTOMATED FORMING OF SLEEVES FOR SLICED PRODUCTS

STATEMENT OF RELATED CASES

This application is a divisional of U.S. patent application Ser. No. 10/628,073, filed Jul. 25, 2003, now U.S. Pat. No. 7,003,929 issued on Feb. 28, 2006, the disclosure of which is incorporated herein in its entirety.

FIELD

The subject matter disclosed herein relates to apparatus and methods for forming film into a sleeve, and in particular apparatus and methods for forming film into a sleeve in a continuous process for the commercial packaging of a food product.

BACKGROUND

The processing of continuous food product into individually wrapped serving portions is desirably accomplished using automated equipment. The use of automated equipment can allow for increased manufacturing efficiencies and productivity. In one such operation, a continuous film is folded into a continuous sleeve. Food product, such as cheese, can be continuously extruded into the sleeve. Once the cheese has been extruded into the sleeve, the continuous sleeve-encased cheese can be further treated and separated into individually packaged slices by sealing and cutting of the sleeve.

One such process for the processing of continuous food product into individually wrapped serving portions involves the folding of the film into the sleeve shape using a two-part forming apparatus having a forming plate adjacent a folding tunnel. The film is unwound from a roll of film and pulled over a forming plate inclined at an angle of between 45 degrees and 75 degrees to a folding tunnel. The forming plate is wide at its base, tapering upward toward an entrance to the folding tunnel. Within the folding tunnel is a cheese extruding tube through which cheese, or other such food products, are extruded. The folding tunnel is configured to form a sleeve around the extruding tube so that the food product leaving a downstream mouth of the extruding tube is encased in a film sleeve.

To this end, the folding tunnel is configured to form the planar film into a sleeve for encasing the extruded cheese. The folding tunnel includes a pair of overlapping angled members. The overlapping angled members are staggered, such that one is contacted by the film before the other. When the film contacts the first of the angled members, one the longitudinal edges of the film is folded over the cheese extruding tube. As the film continuous to be advanced through the folding tunnel, the other of the longitudinal edges of the film contacts the other of the pair of overlapping angled members and is folded over the earlier folded portion of the film. In this manner, the planar film is folded about itself and around the cheese extruding tube. Once the cheese exits the mouth of the cheese extruding tube, the cheese is encased in the advancing sleeve and both are directed toward further operations and finishing steps, including separation into individually wrapped slices of cheese.

There are several disadvantages to the method of forming the sleeve from the film using the forming plate and folding tunnel, such as illustrated in FIG. 17. As the film is pulled over the forming plate and through the folding tube, extreme variations in force exist across the transverse width of the film between the beginning of the forming plate and the exit of the folding tunnel. These variations in force can cause the film to become destabilized as the film tends to shift lengthwise away from the regions of comparatively higher forces. When the film shifts toward the regions of comparatively lower forces, the film may become skewered on the forming plate and enter the folding tunnel at an angle, as opposed to longitudinally aligned with the axis of the folding tunnel. The film may also become skewered within the folding tunnel. Skewering of the film can cause misfeeding thereof, resulting in time consuming down-time for the machine and labor intensive removal of the skewered film and reset-up of the system. These disadvantages reduce the overall efficiency of the packaging apparatus.

Another process for the processing of continuous food product into individually wrapped serving portions involves the folding of the film into the sleeve shape using a folding tunnel having an integral folding ramp surface leading to the entrance of the folding tunnel, such as illustrated in FIGS. 18 and 19 and disclosed in U.S. Pat. No. 4,532,754. The film is unwound from a roll of film and pulled over the folding ramp, which inclined at an angle of about 47 degrees to a longitudinal axis of the folding tunnel. The folding tunnel is formed partially by folded portions of the ramp in addition other portions adjacent thereto. Within the folding tunnel is a cheese extruding tube through which cheese, or other such food products, are extruded. The ramp and the folded portions thereof are embossed with dimples in an attempt to reduce friction forces between the contact surfaces of the film and the film.

The folding tunnel is configured to form a sleeve around the extruding tube so that the food product leaving a downstream mouth of the extruding tube is encased in a film sleeve. Like the multi-part forming apparatus discussed hereinabove, the integrated ramp and folding tunnel are configured to form the planar film into a sleeve for encasing the extruded cheese. The folding tunnel includes a pair of overlapping angled members. The overlapping angled members are staggered, such that one is contacted by the film before the other. When the film contacts the first of the angled members, one the longitudinal edges of the film is folded over the cheese extruding tube. As the film continuous to be advanced through the folding tunnel, the other of the longitudinal edges of the film contacts the other of the pair of overlapping angled members and is folded over the earlier folded portion of the film. The planar film is then folded about itself and around the cheese extruding tube. As the cheese exits the mouth of the cheese extruding tube, the cheese is encased in the advancing sleeve and both are directed toward further operations and finishing steps.

There are several disadvantages to the method of forming the sleeve from the film using the integral ramp and tunnel. One disadvantage is a large variation in forces in the film at the beginning of the ramp and at the exit of the folding tube. The variations in force can cause the film to stretch and skew. Another disadvantage of the prior art integral former is its construction of a thin material. The thin material edges which could cause deformations in the film and increased friction therebetween.

SUMMARY

In order to address deficiencies with prior art forming methods, a new method of forming a film into a sleeve disposed around a filling tube is provided. The method includes the step of feeding the film in a film feed direction over a continuous film entrance surface to an entrance of a folding tunnel. At least a portion of the entrance surface is inclined at an acute angle relative to an extension of a longitudinal axis of the folding tunnel. The method further includes the step of folding a first longitudinal side portion of the film at least partially around the filling tunnel or tube using a first folding wing of the folding tunnel as the film is fed in the film feed direction. The method also includes the step of folding a second longitudinal side portion of the film, disposed opposite the first longitudinal side portion of the film, at least partially around the filling tube and overlapping at least a portion of the first longitudinal side portion of the film using a second folding wing of the folding tunnel as the film is fed in the film feed direction to form the sleeve around the filling tube.

The method of forming a film into a sleeve disposed around a filling tube may also include the step of selecting the acute angle between the portion of the entrance surface and the extension of the longitudinal axis of the folding tunnel to minimize the ratio of tension forces in the film before the continuous film entrance and after the folding tunnel. The acute angle between the portion of the entrance surface and an extension of the folding tunnel, i.e., the film path, may be selected to have the ratio of tension forces in the film before the continuous film entrance and after the folding tunnel be between about 1:1 and 2:1. The acute angle between the portion of the entrance surface and the folding tunnel may be between 40° and 90°, and is preferably about 66°.

The steps of folding a first longitudinal side portion of the film using a first folding wing of the folding tunnel and folding a second longitudinal side portion of the film using a second folding wing of the folding tunnel may each further comprise the step of feeding the film around a folding wing contact edge of each folding wing. Each folding wing contact edge may have a thickness between 0.10 and 0.25 inches and may comprise an arcuate portion in contact with the film. Each folding wing contact edge may be positioned at an acute angle relative to an extension of a longitudinal axis of the folding tunnel.

The method may further include the step of generally maintaining constant forces along a transverse width of the film as the film is formed into a sleeve. The step of generally maintaining constant forces along a transverse width of the film as the film is formed into a sleeve may include the step of feeding the film over contact surfaces of the continuous film entrance surface, the first and second folding wings, and the folding tunnel having geometry selected to maintain a generally constant length of the film between a beginning of the continuous film entrance and an end of the folding tunnel in the film feed direction. By maintaining a generally constant length of the film over the film contact surfaces, the forces in the film will generally be equal across the transverse width thereof. Equal forces across the transverse width of the film can result in a reduction of propensity of the film to shift laterally from areas of higher forces to areas of lower forces when such force variations are minimized.

An apparatus is provided for forming a film into a sleeve around a filling tube. The apparatus comprises a continuous film entrance surface integrally connected to an entrance of a folding tunnel. At least a portion of the entrance surface is inclined at an acute angle relative to an extension of a longitudinal axis of the folding tunnel. A first folding wing of the folding tunnel is positioned for folding a first longitudinal side portion of the film at least partially around the filling tunnel. A second folding wing of the folding tunnel is positioned for folding a second longitudinal side portion of the film, disposed opposite the first longitudinal side portion of the film, at least partially around the filling tunnel and overlapping at least a portion of the first longitudinal side portion of the film in order to form a sleeve around the filling tube.

The continuance film entrance surface may comprise a generally planar central portion positioned between a pair of curved side portions. Curved side portions of the continuous film entrance surface may each be connected to one of the first and second folding wings.

The acute angle between the portion of the entrance surface and the extension of the longitudinal axis of the folding tunnel may be selected to minimize the ratio of tension forces in the film before the continuance film entrance and after the folding tunnel. The acute angle between the portion of the entrance surface and an extension of a longitudinal axis of the folding tunnel may be selected to have the ratio of tension forces in the film before the continuance film entrance surface and after the folding tunnel be between 1:1 and 2:1. The acute angle between the portion of the entrance surface and the extension of the longitudinal axis of the folding tunnel may be between 40° and 90°, and is preferably about 66°.

Each of the first and second folding wings may include a folding wing contact edge being arcuate and having a radius of between 0.05 and 0.15 inches. Each folding wing contact edge may be positioned at an acute angle relative to an extension of the longitudinal axis of the folding tunnel.

Film contact surfaces of the continuous film entrance surface, the first and second folding wings, and the folding tunnel may have geometry selected to maintain a generally constant length of the film between a beginning of the continuous film entrance and an end of the folding tunnel in the film feed direction. By maintaining a generally constant length of the film between the beginning of the continuous film entrance and the end of the folding tunnel, variations in tension forces across the transverse width of the film can be minimized. This can result in a lack of propensity for the film to shift from regions of higher force to regions of lower force, which can reduce occurrences of the film being misfed or skewered in the apparatus. A maximum transverse width of the contact surfaces of the folding tunnel and first and second folding wings in an unfolded configuration of the folding tunnel may be approximately the same as a transverse width of the film.

The apparatus may be formed of material approximately 0.125 inches thick. Such a thickness assists in insuring that appropriate radiuses are present on contact surfaces with the film in order to reduce stretching and unnecessary forces in the film. The material may comprise stainless steel 17-4PH. In addition, the contact surfaces of the apparatus are preferably free of plating in order to reduce flaking thereof and the generation of minute sharp edges on the contact surfaces which can harm the film.

In another aspect of the method, the method of forming a film into a sleeve disposed around a filling tube includes the step of feeding the film in a film feed direction through a folding tunnel disposed around the filling tube. The folding tunnel and filling tube are each operatively connected to a common support member. The method further includes the step of folding a first longitudinal side portion of the film at least partially around the filling tube as the film moves in the film feed direction. The method also includes the step of folding a second longitudinal side portion of the film, disposed opposite the first longitudinal side portion of the film, at least partially around the filling tunnel and overlapping at least a portion of the first longitudinal side portion of the film as the film moves in the film feed direction to form the sleeve around the filling tube.

The method may also include having the common support member pivotally connected by a pivot relative to a support bracket, effective to allow selective rotation of the forming tube and filling tunnel relative to the support bracket. A second folding tunnel may be disposed around a second filling tube and disposed adjacent the first folding tunnel and first folding tube and operably attached relative to the support bracket. The common support member may be pivotable about the pivot to provide access to the second folding tunnel and second filling tube. The method may further comprise the step of stabilizing the forming tunnel relative to the filling tube using the common support member effective to permit spacing between the outer surfaces of the filling tube and adjacent inner surfaces of the forming tube to be minimized.

In accordance with another aspect of the method, a method is provided of forming a film into a sleeve disposed around a filing tube including the step of feeding the film in a film feed direction through a folding tunnel disposed around the filling tube. The folding tunnel has a first longitudinal portion and a second longitudinal portion selectively separable relative to the second longitudinal portion. The method further includes folding a first longitudinal side portion of the film at least partially around the filling tunnel as a film moves in a film feed direction using a first folding wing attached to the first longitudinal portion of the folding tunnel. The method also includes the step of folding a second longitudinal side portion of the film, disposed opposite the first longitudinal side portion of the film, at least partially around the filling tunnel and overlapping at least a portion of a first longitudinal side portion of the film as the film moves in a film feed direction using a second folding wing attached to the second longitudinal portion of the forming tunnel to form the sleeve.

The method may also include having a first mounting bracket attached to the first longitudinal portion of the forming tunnel and a second mounting bracket attached to the second longitudinal portion of the forming tunnel. The first and second mounting brackets may have a connection mechanism therebetween permitting selective separation of the first and second mounting brackets in the first and second longitudinal side portions effective to permit access to the interior of the forming tunnel. By having such a separable folding tunnel, the method permits the ready separation of the folding tunnel halves in order to perform cleaning and other operations in a simplified manner.

DETAILED DESCRIPTION OF THE DRAWINGS

Figure 1:
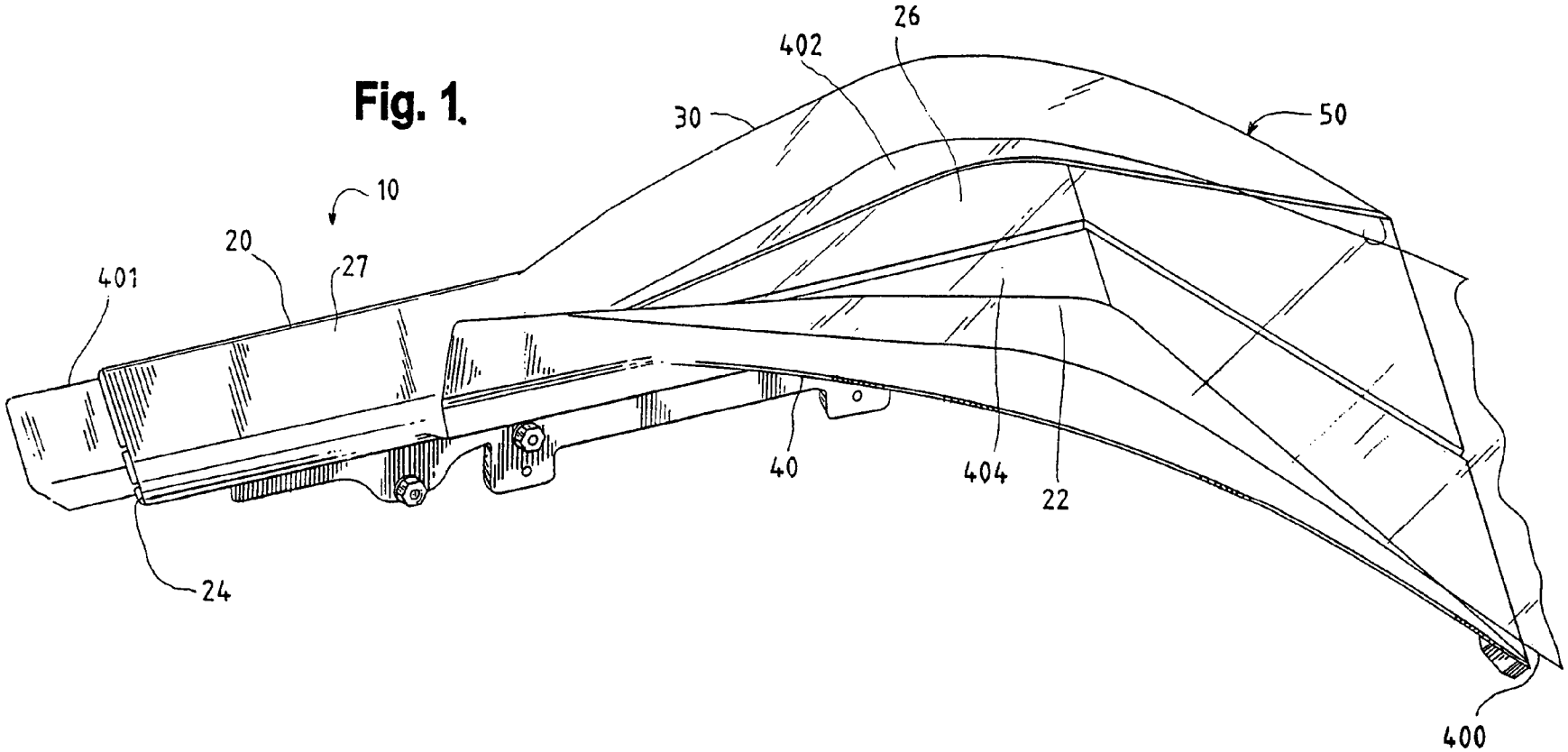
FIG. 1 is a top perspective view of an apparatus for forming a film into a sleeve around a filling tube showing film being directed therethrough and formed into a sleeve.
Figure 2:
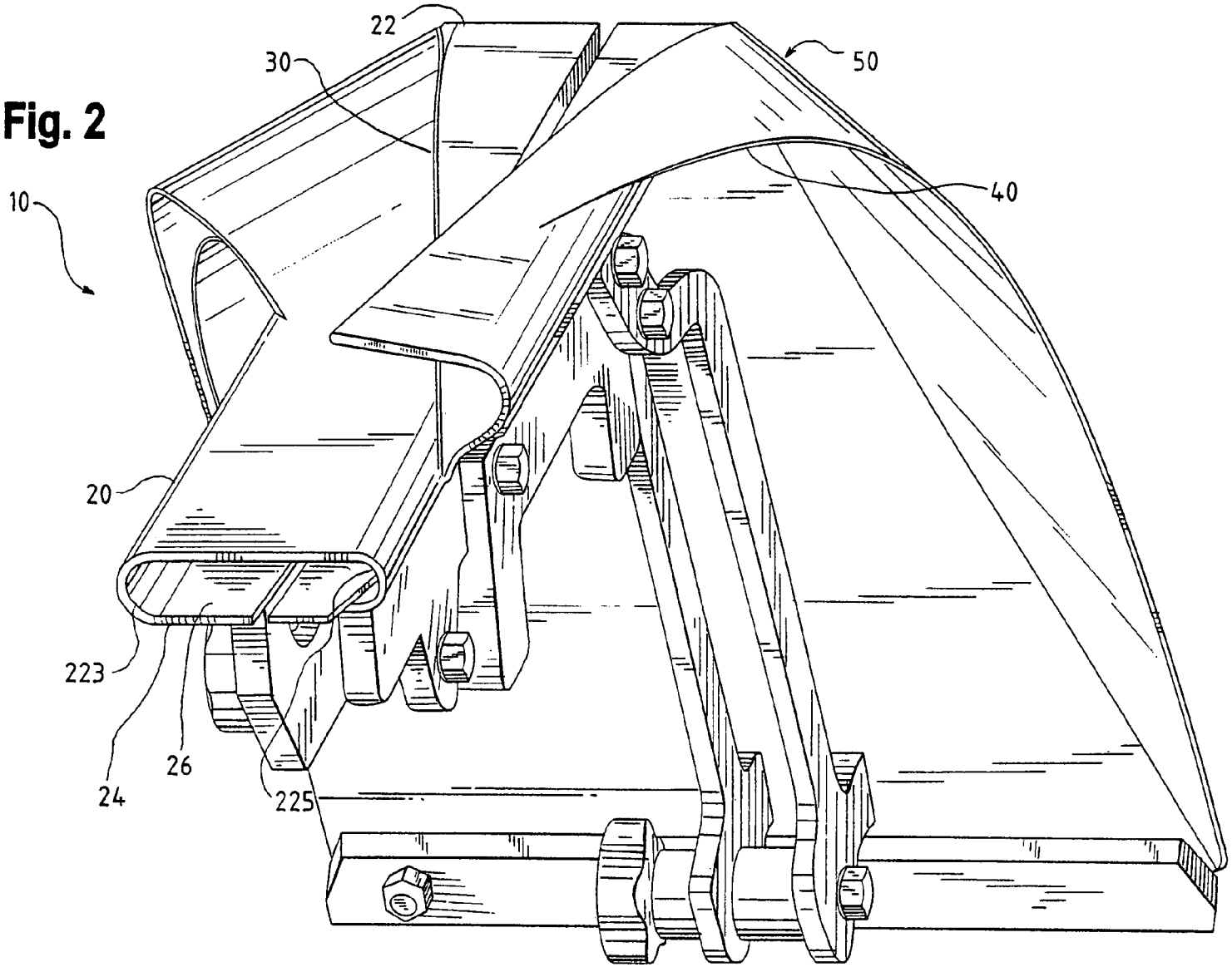
FIG. 2 is an end perspective view of the apparatus of FIG. 1.
Figure 3:
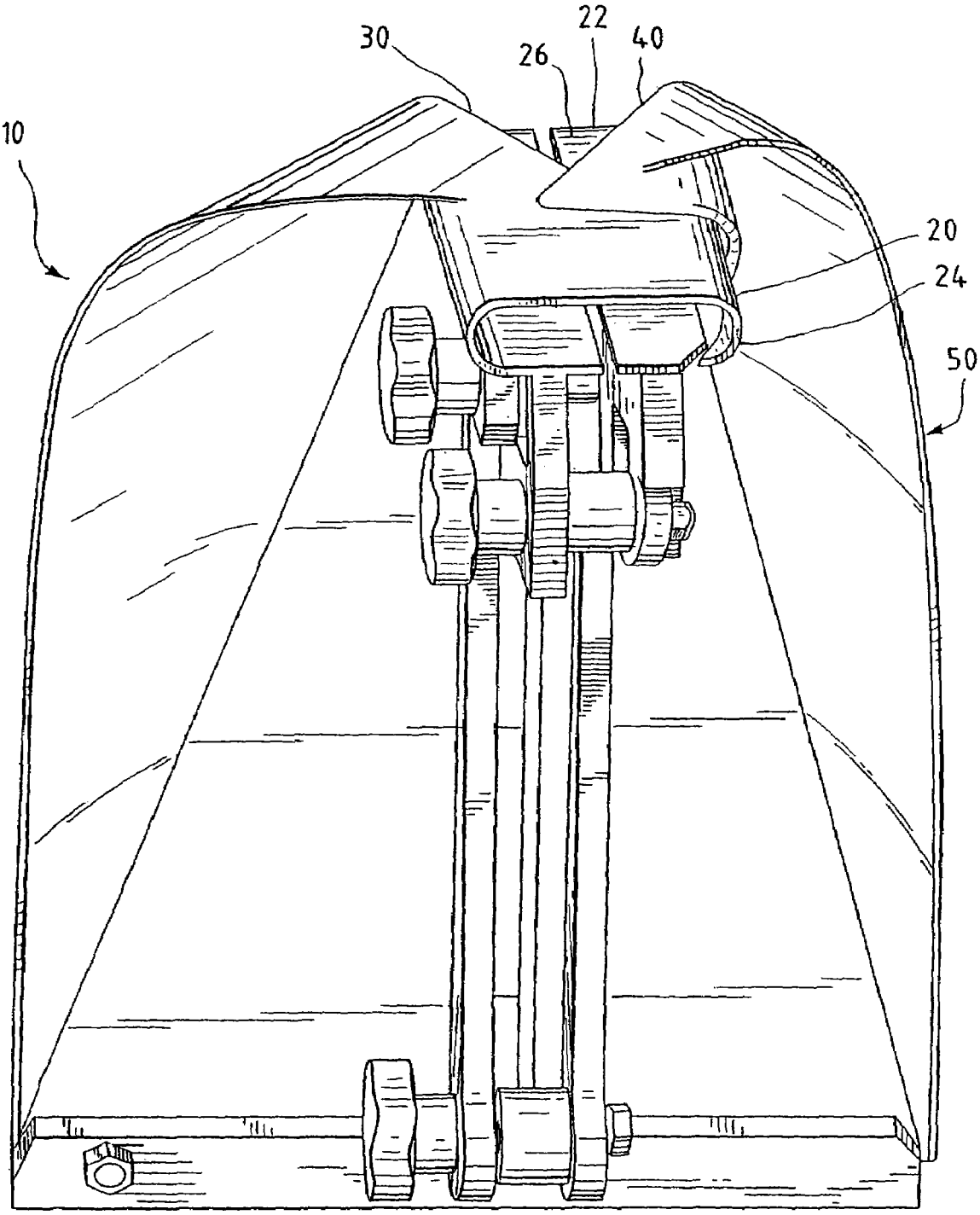
FIG. 3 is another end perspective view of the apparatus of FIG. 1.
Figure 4:
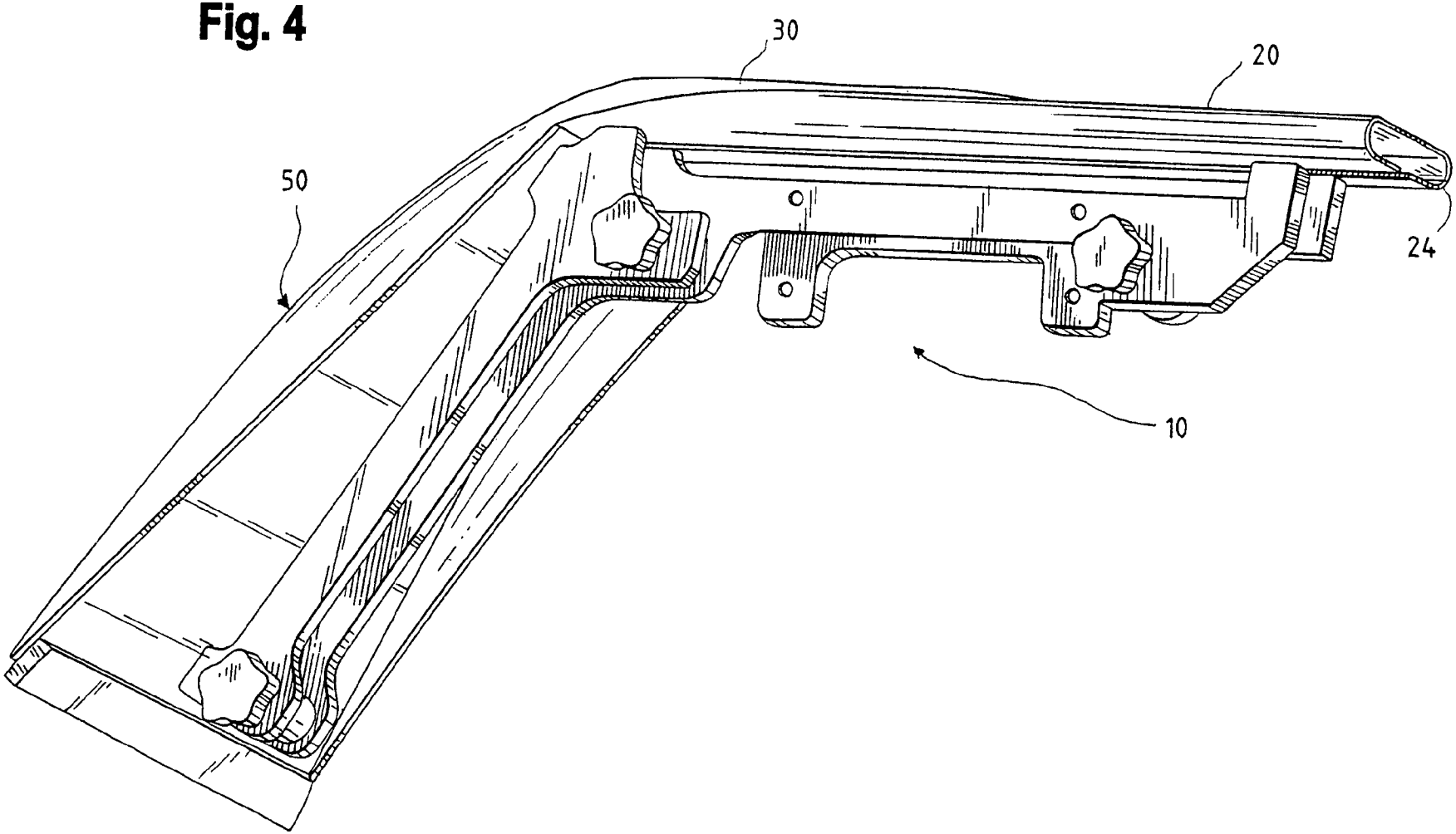
FIG. 4 is a right side perspective view of the apparatus of FIG. 1.
Figure 5:
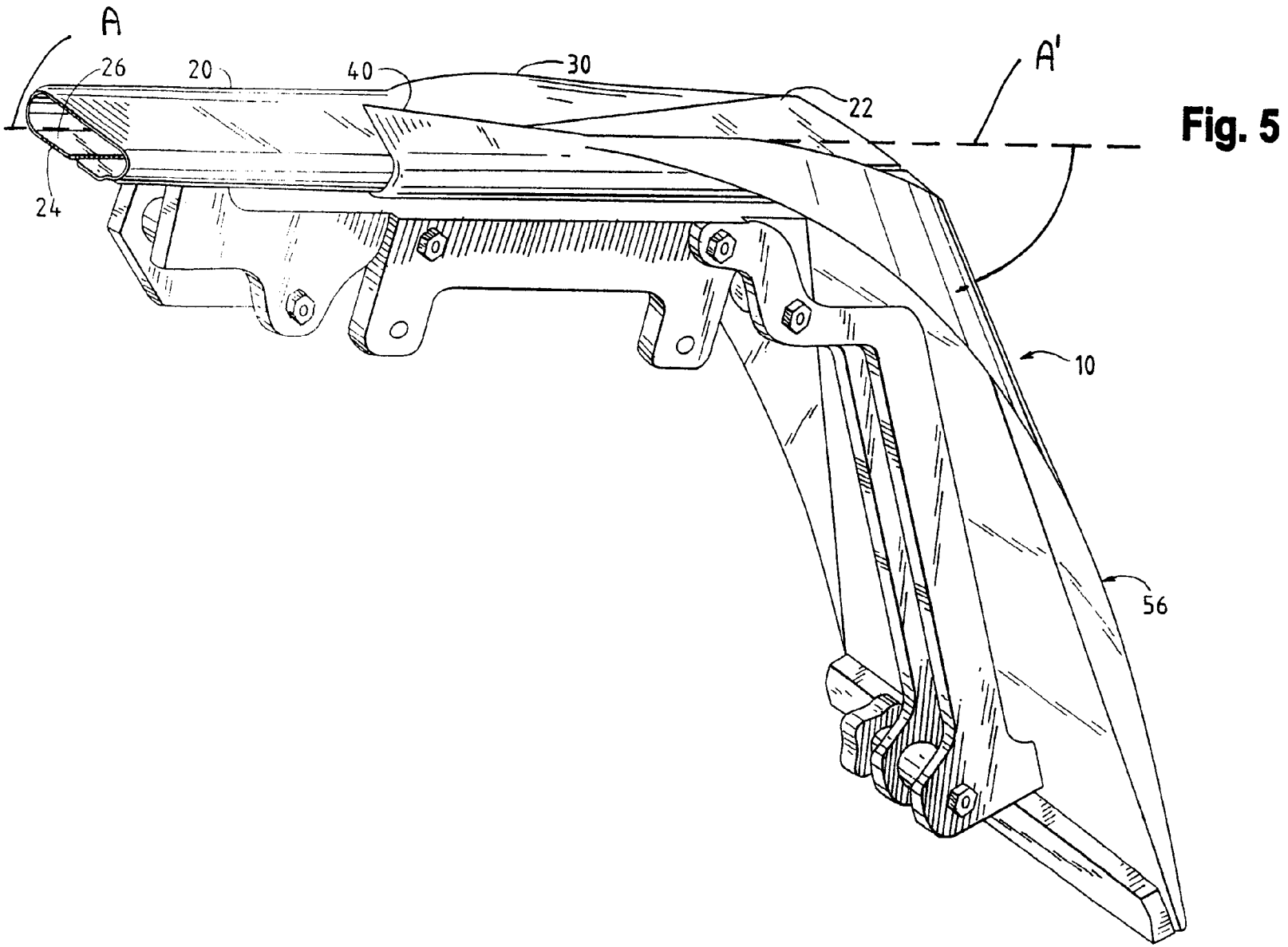
FIG. 5 is a left side perspective view of the apparatus of FIG. 1.

There is provided a new forming apparatus 10 for forming a film 400 into a sleeve 401 around a filling tube 90, as shown in FIGS. 1-16. The forming apparatus 10 has contact surface geometry that is contacted by the film 400 as it travels thereacross configured to ensure smooth forming of the film 400 into the sleeve 401. Smooth forming of the film 400 into the sleeve 401 is achieved, in part, by reducing longitudinal tensile forces in the film 400. Reducing longitudinal tensile forces in the film 400 reduces stretching of the film 400, which can cause the film 400 to misfeed and unnecessarily deformation of the film 400. Smooth forming of the film 400 into the sleeve 401 is also achieved, in part, by selecting the contact surface geometry to minimize transverse variations in tensile forces in the film 401. Reducing transverse variations in the tensile forces in the film 401 contributes to maintaining the film 400 properly aligned throughout the processing of forming the film 400 into a sleeve 401, thereby minimizing misfeeds, such as due to skewering, and associated machine downtime. Smooth forming of the film 400 into the sleeve 401 is further achieved, in part, by having contact edges of the contact surfaces shaped to reduce unnecessary stresses in the film 400.

The forming apparatus 10 is configured for integration with a continuous, automated high speed operation for forming film 400 into a sleeve 401 for use in commercial food manufacturing and packaging operations. To this end, the forming apparatus 10 is configured to permit selective access to an interior thereof, such as to permit periodic cleaning and maintenance that may be required in a food packaging environment, as discussed further herein. The forming apparatus 10 is also configured to permit use in conjunction with one or more additional and similar forming apparatus 100 by adapting a mounting frame 200 to permit movement of one forming apparatus 10 to allow access to another of the forming apparatus 100 disposed adjacent thereto, as will be discussed in greater detail herein.

As illustrated in FIGS. 1-5, the forming apparatus 10 comprises a continuous entrance surface 50 for the film 400. The continuous entrance surface 50 extends at an inclined angle to an entrance 22 of a horizontally extending folding tunnel 20. The angle between the continuous entrance surface 50 and an extension A' of a longitudinal axis A of the folding tunnel 20 is acute, as will be discussed in more detail. That is, film 400 traveling from the continuous entrance surface 50 to the folding tunnel 20 has a change in its direction of travel of an acute angle. The folding tunnel 20 has a pair of folding wings 30 and 40 positioned on an upper surface 27 thereof in a staggered relationship and on opposing sides of the folding tunnel 20. As will be discussed in greater detail herein, surfaces of the continuous entrance surface 50, the folding tunnel 20, and the first and second folding wings 30 and 40 that contact the film 400 as it is directed thereacross have geometries selected to minimize force variations across the transverse width of the film 400 in order to reduce skewering of the film 400 in the folding tunnel 20 and ensure smooth movement of the film 400 through the forming apparatus 10.

Figure 8:
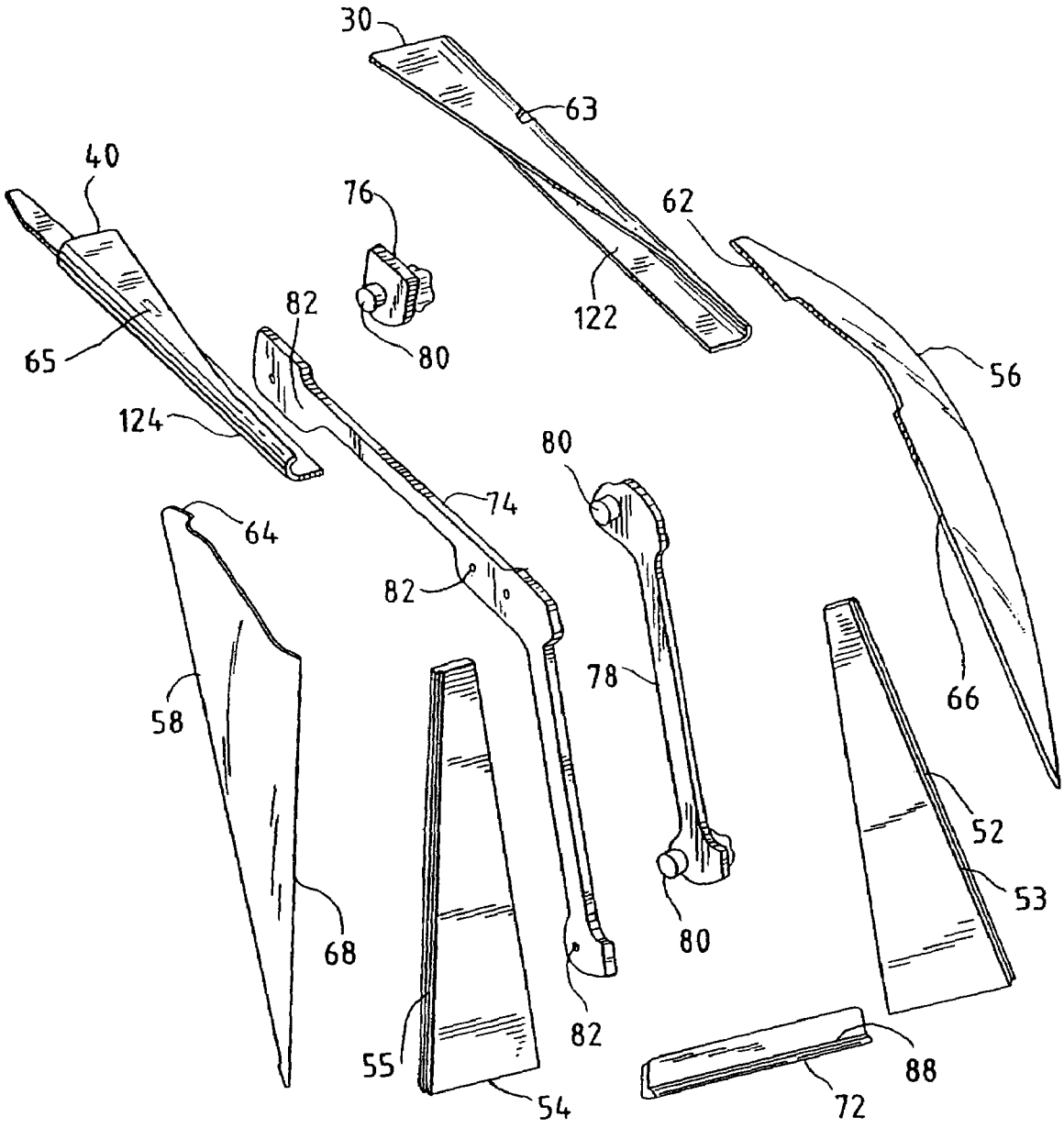
FIG. 8 is an exploded perspective view of the apparatus of FIG. 1.
Figure 9:
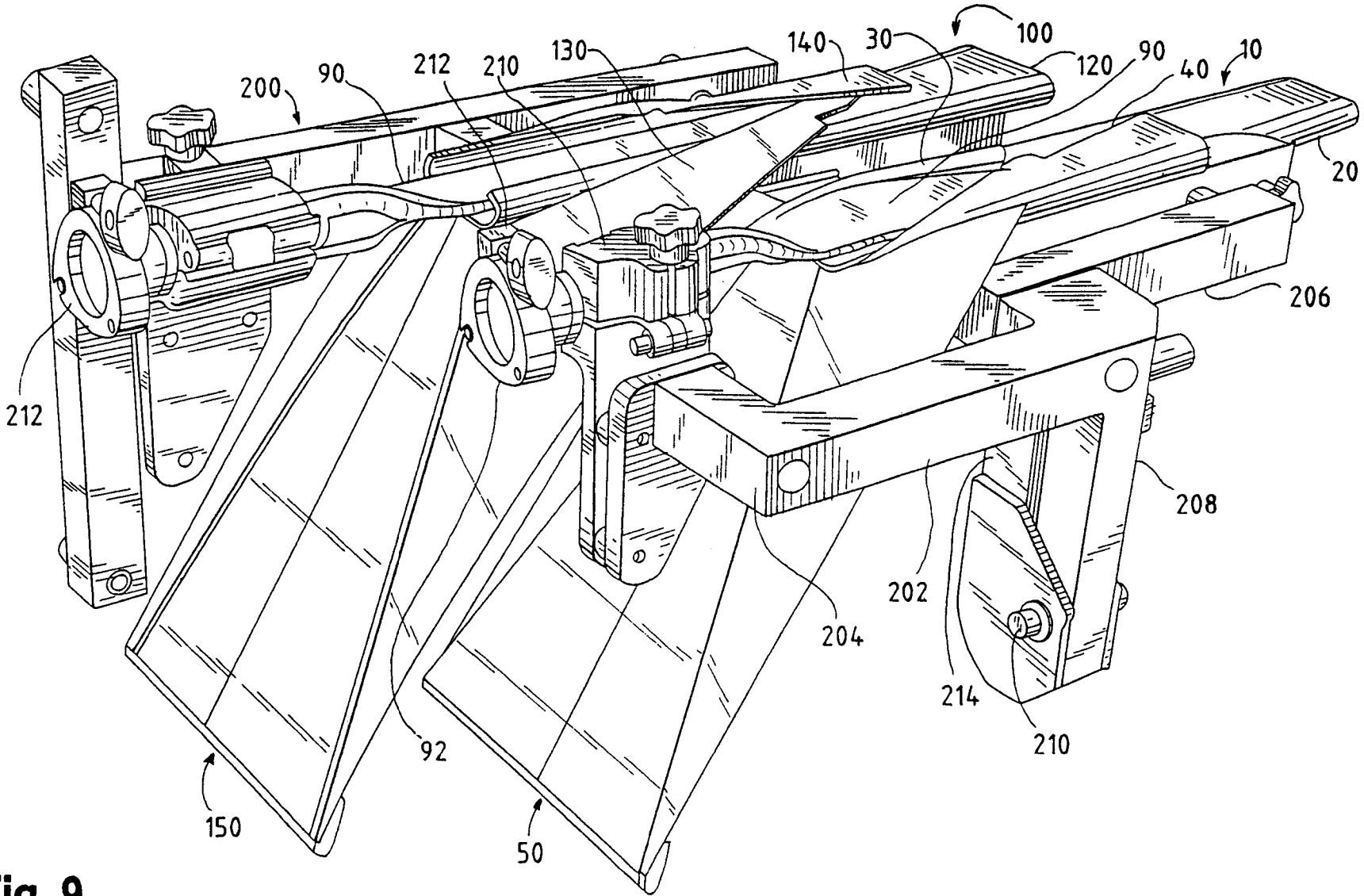
FIG. 9 is a top perspective view of the apparatus of FIG. 1 and a similar second apparatus mounted to a mounting bracket assembly.
Figure 10:
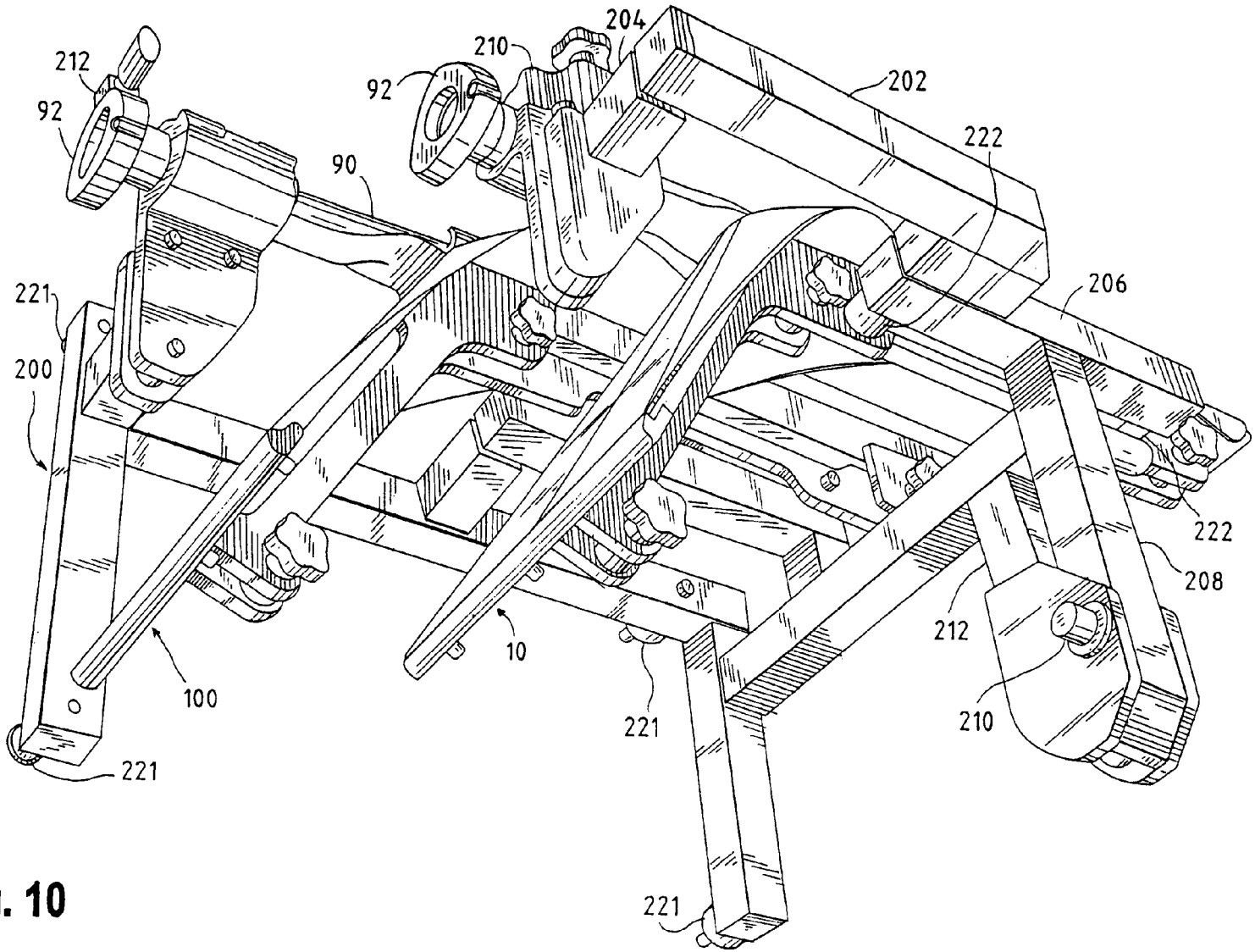
FIG. 10 is a bottom perspective view of the apparatus and the similar second apparatus mounted to the mounting bracket assembly of FIG. 9.

Inserted within the folding tunnel is a filling tube, as shown in FIGS. 9 and 10. The inner surfaces of the folding tunnel 20 and the outer surfaces of the filling tube 90 are sized to have a space therebetween through which the film 400, and the film 400 as folded into a sleeve 401, can be directed. As the film 400 is feed over the continuous entrance surface 50, it is directed through the entrance 22 of the folding tunnel 20. A center portion of the film 400 is directed beneath the filling tube 90 beginning proximate the entrance 22 of the folding tunnel 20. As the film 400 continues to be advanced through the folding tunnel 20, a first longitudinal edge portion 402 of the film 400 will contact a first one of the folding wings 30 and be gradually folded at least partially over the filling tube 90. As the film 400 is further fed through the folding tunnel 20, a second longitudinal edge portion of the film 404, opposite the first longitudinal edge portion 402 thereof, contacts a second one of the folding wings 40 and is gradually folded at least partially over the filling tube 90 and the first longitudinal edge portion 402 of the film 400. Turning to more of the details of the forming apparatus 10, the forming apparatus 10 comprises a pair of generally planar panels 52 and 54, as illustrated in FIG. 8. These generally planar panels 52 and 54 are wedge-shaped, tapering from a wider base to a narrower width adjacent entrance 22 of the folding tunnel 20. The wider bases of the generally planar panels 52 and 54 are connected by a joining piece 72. The joining piece 72 has a lip or groove 88 for receiving the bottom ends of the planar panels 52 and 54 is a secure fashion. One of the planar panels 52 is bolted or otherwise secured to the joining piece 72. The other planar panel 54 removable from the joining piece 72 for purposes as will be described further.

The planar panels 52 and 54 are positioned adjacent each other. The periphery side edge of each of the planar panels 52 and 54 is connected to a curved side panel 56 or 58. The tapered or angled periphery side edges of the planar panels each have a lip formed therein 53 and 55. The lips 53 and 55 are each configured to receive an edge portion 66 or 68 of a side curved panel 56 and 58. By providing such lips 53 and 55, the side curved panels 56 and 58 can be secured along one of their lengths and substantially prevented from skewing relative to the planar panels 52 and 54. Portions of the curved side panels 56 and 58 and the planar panels 52 and 54 form the continuous entrance surface 50. The continuous entrance surface 50 provides a continuous surface for supporting the film 400 along its entire extent as it moves thereacross.

Figure 6:
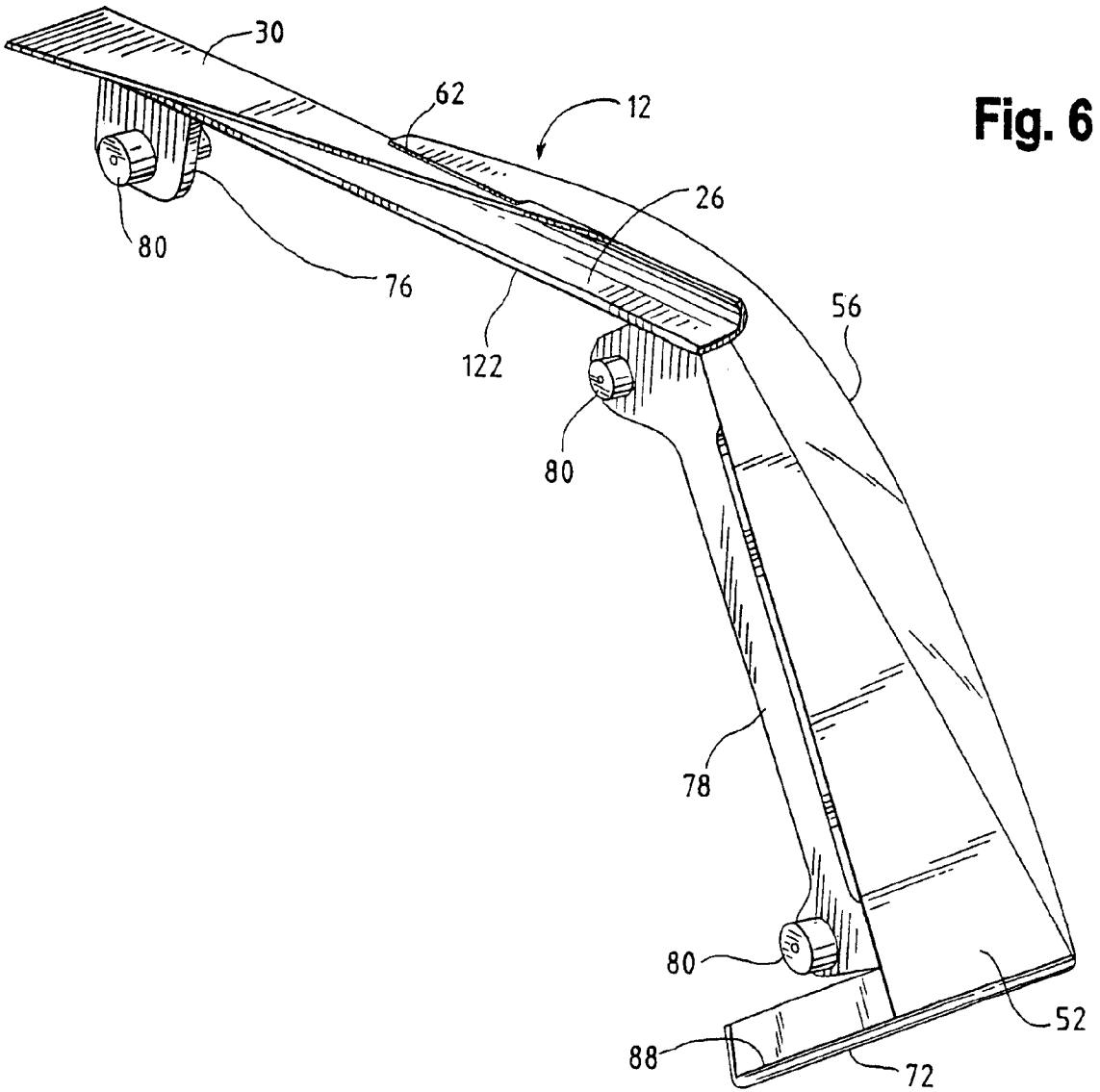
FIG. 6 is a perspective view of a first portion of the apparatus of FIG. 1 with a second portion of the apparatus removed.
Figure 7:
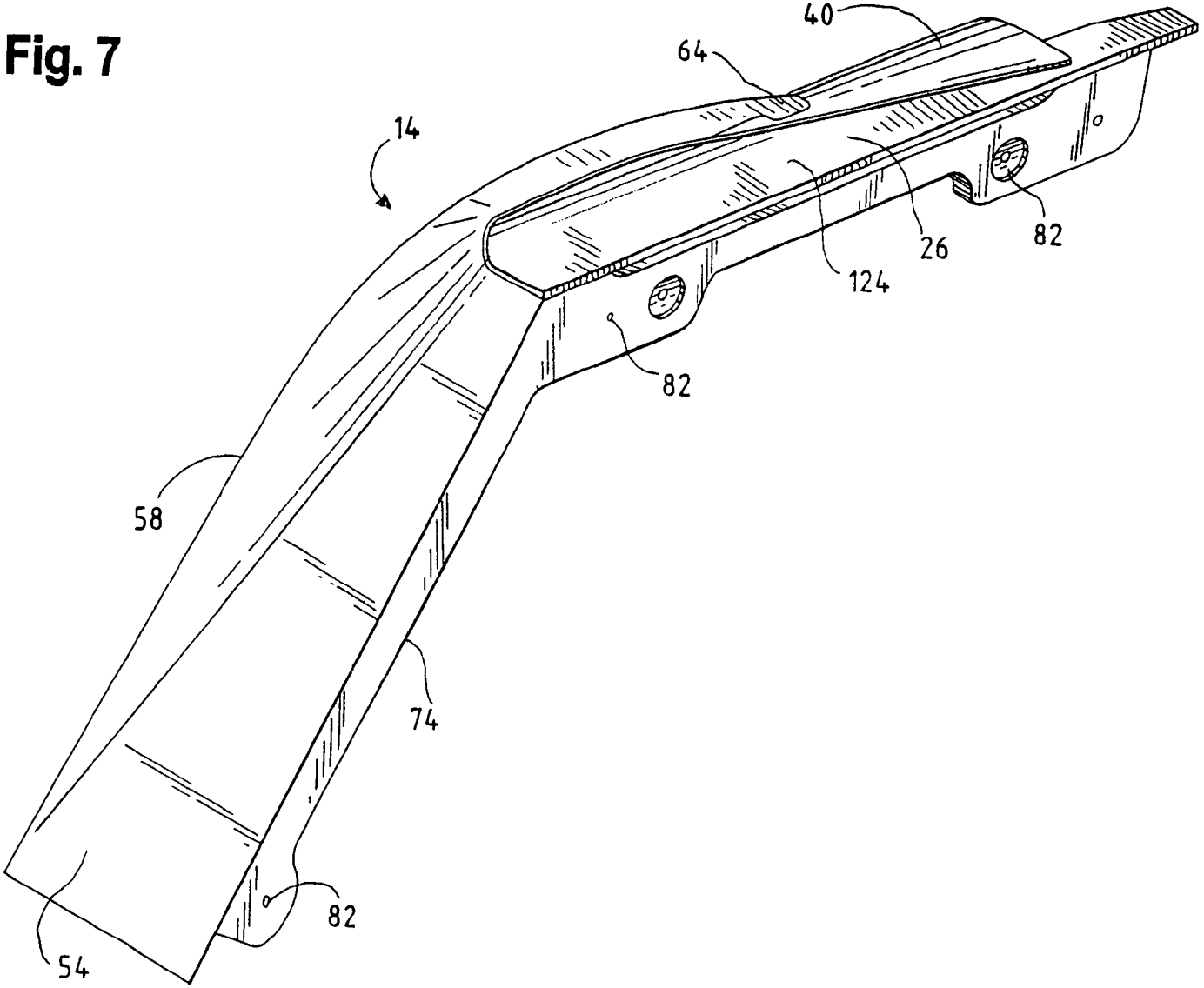
FIG. 7 is a perspective view of the second portion of the apparatus of FIG. 1 with a first portion of the apparatus removed.

The folding tunnel 20 comprises a partially enclosed region extending between an entrance 22 and exit 24 thereof. The folding tunnel 20 is generally oval in cross-section, having an upper surface and a lower surface connected at edges thereof by arcuate, longitudinally-extending side regions 223 and 225. Upper regions of the curved side panels 56 and 58 are attached to the upper surface of the folding tunnel 20 on opposite sides thereof, as shown in FIGS. 6 and 7. The upper surface of the folding tunnel 20 is comprised of the first and second folding wings 30 and 40. To secure the connection and proper positioning between the curved side panels 56 and 58 and the first and second folding wings 30 and 40, keys 62 and 64 are provided on the curved side panels 56 and 58. Inserts 63 and 65 are formed on the upper surfaces of the first and second folding wings 30 and 40 and sized to mate with the keys 62 and 64 of the curved side panels 56 and 58.

The forming apparatus 10 is readily separable into a first half 12 and a second half 14, as shown in FIGS. 6 and 7, respectively. Having the forming apparatus 10 separable into the first and second halves 12 and 14 advantageously allows for access to the interior of the folding tunnel 20 in order to permit cleaning and other interior operations.

The first half 12 of the forming apparatus 10 includes one of the planar panels 52, one of the side curved portions 56, and a first half of the folding tunnel 122 having the first folding wing 30. The second half 14 of the forming apparatus 10 includes the other of the planar panels 54, side curved portions 58 and the second half 124 of the folding tunnel having the second folding wing 40.

The components of the first half 12 of the forming apparatus 10 are mounted to an arm bracket 78 and an end bracket 76. The arm bracket 78 is mounted to the underside of the planar panel 52 and the underside, towards the entrance 22, of the first half 122 of the folding tunnel 20. The end bracket 76 is mounted on the underside of the first half 122 of the folding tunnel 20 and toward the exit 24 thereof. The wider bottom portion of the planar panel 52 has the joining piece 72 attached thereto. The groove 88 of the joining piece 72 is configured to receive the other planar panel 54 of the forming apparatus 10 and is sized to restrict relative movement between the panels 52 and 54 when the first and second halves 12 and 14 are joined.

Mounted on the underside of the components of the second half 14 of the forming apparatus 10 is an elongated bracket 74. The elongated bracket 74 has a plurality of holes 82 for alignment with bolts 80 disposed in the end bracket 76 and arm 78 mounted to the first half 12 of the forming apparatus 10. The bolts 80 or other suitable means of connection allow for selective joining of the first and second halves 12 and 14 of the forming apparatus 10. In operation, the first and second halves 12 and 14 of the forming apparatus 10 are tightly held together so that minimal gaps therebetween exist. In order to separate the first and second forming halves 12 and 14, such as for cleaning, the bolts 80 or other securement mechanisms can be selectively released.

The geometry of the contact surfaces of the forming apparatus 10 are selected to minimize stress on the film 400 to result a smooth forming of the film 400 into the sleeve 401. In addition to the geometry of the contact surfaces, smooth forming of the film 400 into the sleeve 401 is assisted by a reduction of the angle between the continuous entrance surface 50 and an extension A' of the longitudinal axis A of the folding tunnel 20 along the film feed path. The angle therebetween is selected to reduce the overall tension in the film 400, as will be discussed further herein. The placement of the first and second folding wings 30 and 40 in the film feed direction relative to the mouth or entrance 22 of the folding tunnel 20 is chosen to reduce stresses in the film, such as may be present in the closely-spaced folding surfaces and entrance of the prior art integral former of FIGS. 18 and 19.

The forming apparatus 10 is configured to reduce the ratio of the tension forces in the film 400 at the beginning of the continuous entrance surface 50 and at the exit 24 of the folding tunnel 20. One factor affecting the ratio of the forces include the coefficient of friction between the film 400 and the contact surfaces of the forming apparatus 10. Another factor is the angle between the direction of the tension forces in the film 400 at the beginning of the continuous entrance surface 50 and the direction of the tension force at the exit 24 of the folding tunnel 20. When the coefficient of friction between the film 400 and the contact surfaces of the forming apparatus 10 is designated as $\mu$, the tension forces at the beginning of the continuous entrance surface 50 is designated as $P_1$, the tension forces at the exit 24 of the folding tunnel 20 is designated as $P_2$, and the angle between the direction of the tension forces at the beginning of the continuous entrance surface 50 and the direction of the tension forces at the exit 24 of the folding tunnel 20 is designated as $\theta$, the following relationship exists:

$$P_1/P_2=e^{\theta\mu} \qquad \text{Equation 1}$$

Figure 18:
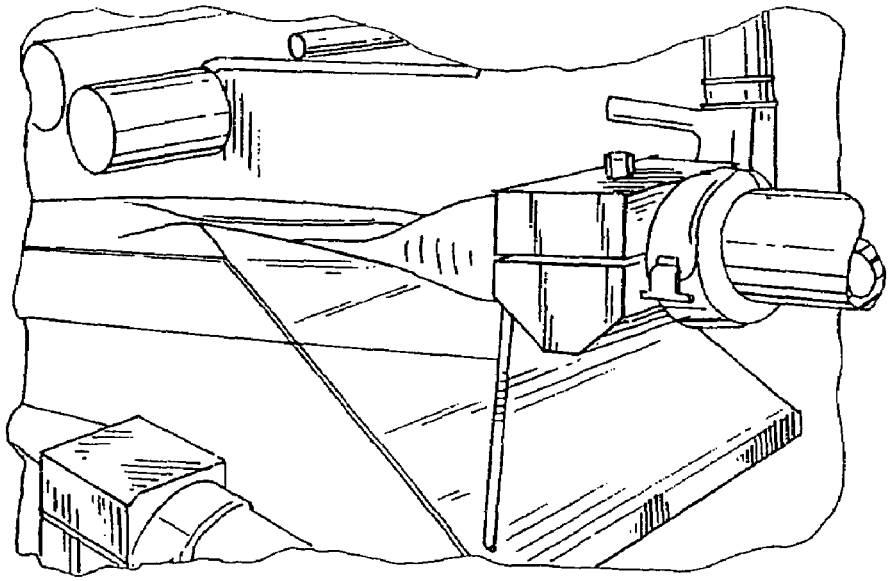
PRIOR ART Fig. 18
FIG. 18 is a perspective view of a prior art integral forming apparatus.
Figure 19:
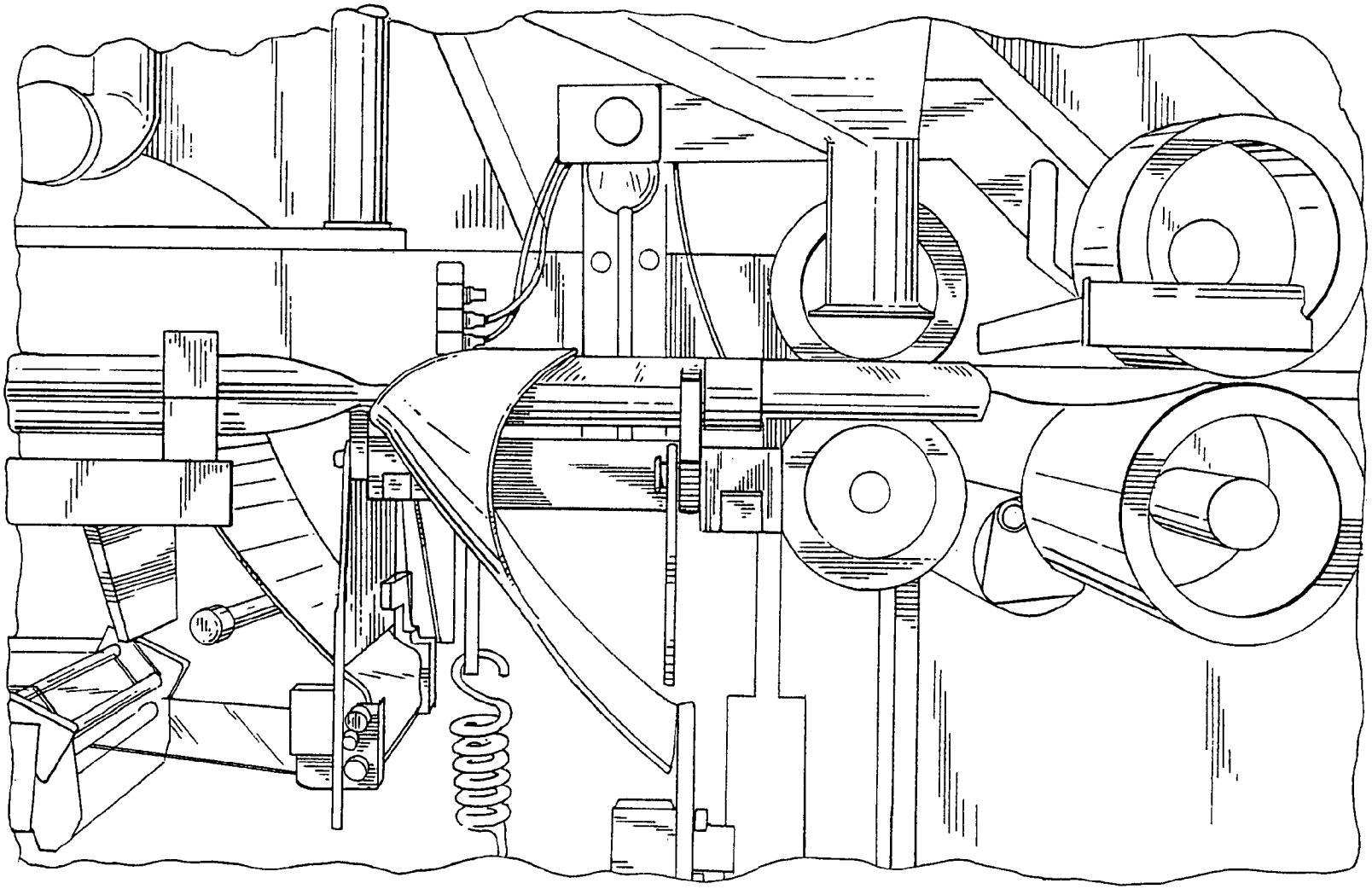
Fig. 19 PRIOR ART
FIG. 19 is a side view of the prior art integral forming apparatus of FIG. 18.
Figure 20A:
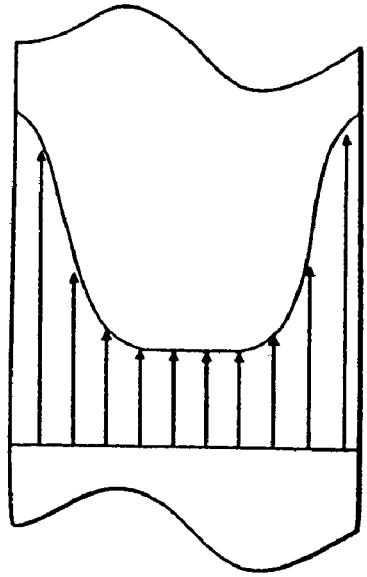
Fig. 20a (Prior Art)
FIG. 20A is a representative of tension forces in the film due to the prior art forming apparatus of FIG. 17.
Figure 20B:
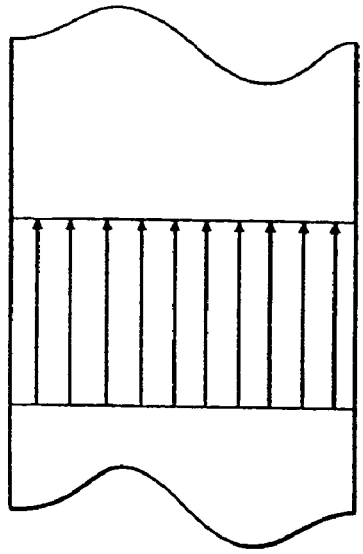
Fig. 20b (Prior Art)
FIG. 20B is a representative of tension forces in the film due to the prior art forming apparatus of FIGS. 18 and 19.
Figure 20C:
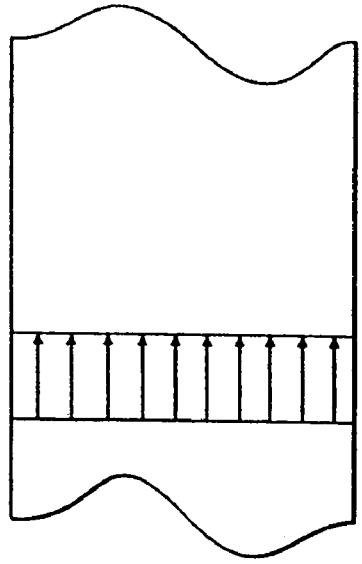
FIG. 20C is a representative of tension forces in the film due to the forming apparatus of FIG. 1.

The coefficient of friction between the film 400 and the forming apparatus 10 was estimated to be about 0.33. The angle between the direction of the tension forces at the beginning of the entrance surface and the direction of the tension forces at the exit of the prior art integral former of FIGS. 18 and 19 is about 133 degrees. Using this coefficient of friction, the ratio of tension forces in the film at the beginning of the entrance surface ($P_1$) and at the exit ($P_2$) for the prior art integrated former was about 2.15. By comparison, the angle between the direction of the tension forces at the beginning of the continuous entrance surface 50 and the direction of the tension forces at the exit 24 of the folding tunnel 20 is about 66 degrees. Thus, the ratio of tension forces in the film 400 at the beginning of the continuous entrance surface 50 ($P_1$) and at the exit 24 of the folding tunnel 20 ($P_2$) for the forming apparatus 10 is about 1.46. The ratios for the prior art integral former and the forming apparatus 10, along with the ratios for various contact angles, are plotted in the chart of FIG. 14. FIGS. 20B and 20C illustrate the anticipated reduction in magnitude of tension forces between the prior art integral former and the forming apparatus 10.

The forming apparatus 10 is further configured to reduce variations in tension forces across the transverse width of the film 400 during forming into the sleeve 401. This can be accomplished by configuring the geometry of film contact surfaces to aid in smooth forming of the film 400 into the sleeve 401. The contact surfaces for the film 400 include portions of the continuous entrance surface 50, folding tunnel 20, and first and second folding wings 30 and 40.

One method of configuring the geometry of the contact surfaces is to have the tensile forces across a given width of the film 400 be constant. This can reduce variations in such tensile forces and thereby reduce the propensity of the film 400 to skewer, such as by moving laterally from an area of higher tensile force to an area of lower tensile force. FIGS. 20A and 20C illustrate the anticipated reduction in tension force variations between the prior art separate former and the forming apparatus 10. As can be seen in FIG. 20A, the film in the prior art former can tend to shift toward the center of the film due to higher forces along the lateral edge portions thereof.

To assist in determining the geometry of the contact surfaces, the film 400 can be modeled as comprising an infinite number of longitudinally-extending springs. The equation for calculating the force (F) in a spring, having a given spring constant (k), that has been stretched a predetermined amount (l) is as follows:

$$F=kl \qquad \text{Equation 2}$$

Using this equation, a goal in configuring the surface geometry is to have the forces due to stretching of the film 400 be generally constant across the width of the film. That is, the term generally constant is used to mean that the tensile forces in the film 400 should not vary so significantly during normal forming operations so as to cause the film 400 to become unintentionally skewered in the forming apparatus 10.

Figure 15:
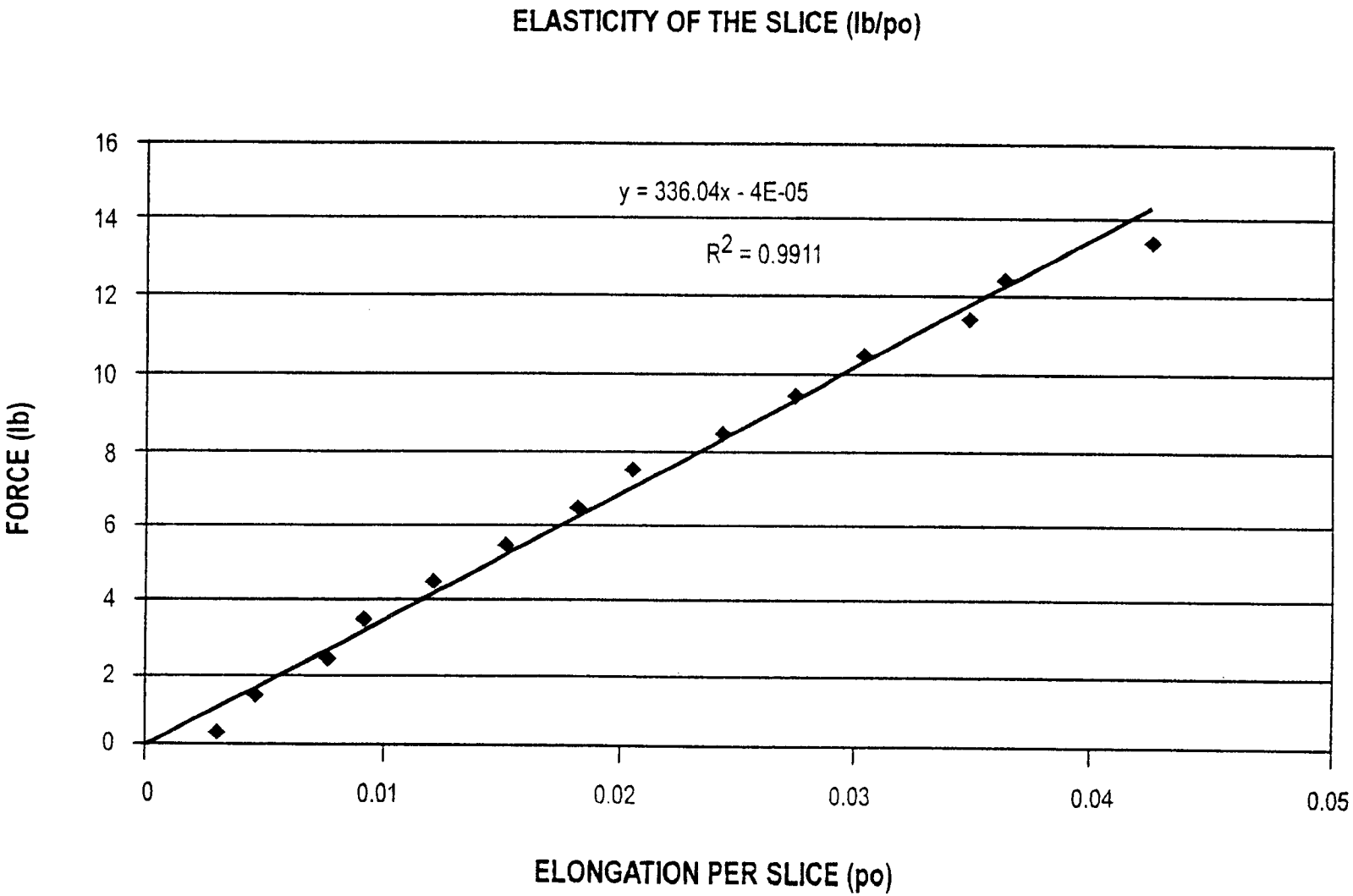
FIG. 15 is a representative chart of the elasticity in the sleeve comparing the tension force in the sleeve and the amount of elongation of the sleeve.

One method of having the forces for the many hypothetical springs longitudinally aligned to model the film 400 be generally constant is to have the length of the hypothetical springs each be about the same. Given that the spring constant (k) would be about the same for each of the hypothetical springs due to being actually formed of the same film material, which may be a single or multiple layer polymer, maintaining generally constant spring tension forces across the width 410 of the film 400 can therefore be accomplished by having the length of each of the hypothetical springs be about the same. As shown in the chart of FIG. 15, there is a correlation between the amount of stretching in the film 400, such as can be measured per length of packaged slice product, and the force exerted on the film 400. To apply this theory to the film 400, the forming apparatus 10 is configured to have contact surfaces with a geometry configured to generally maintain a constant length of the film 100 as it is fed thereover.

Figure 11:
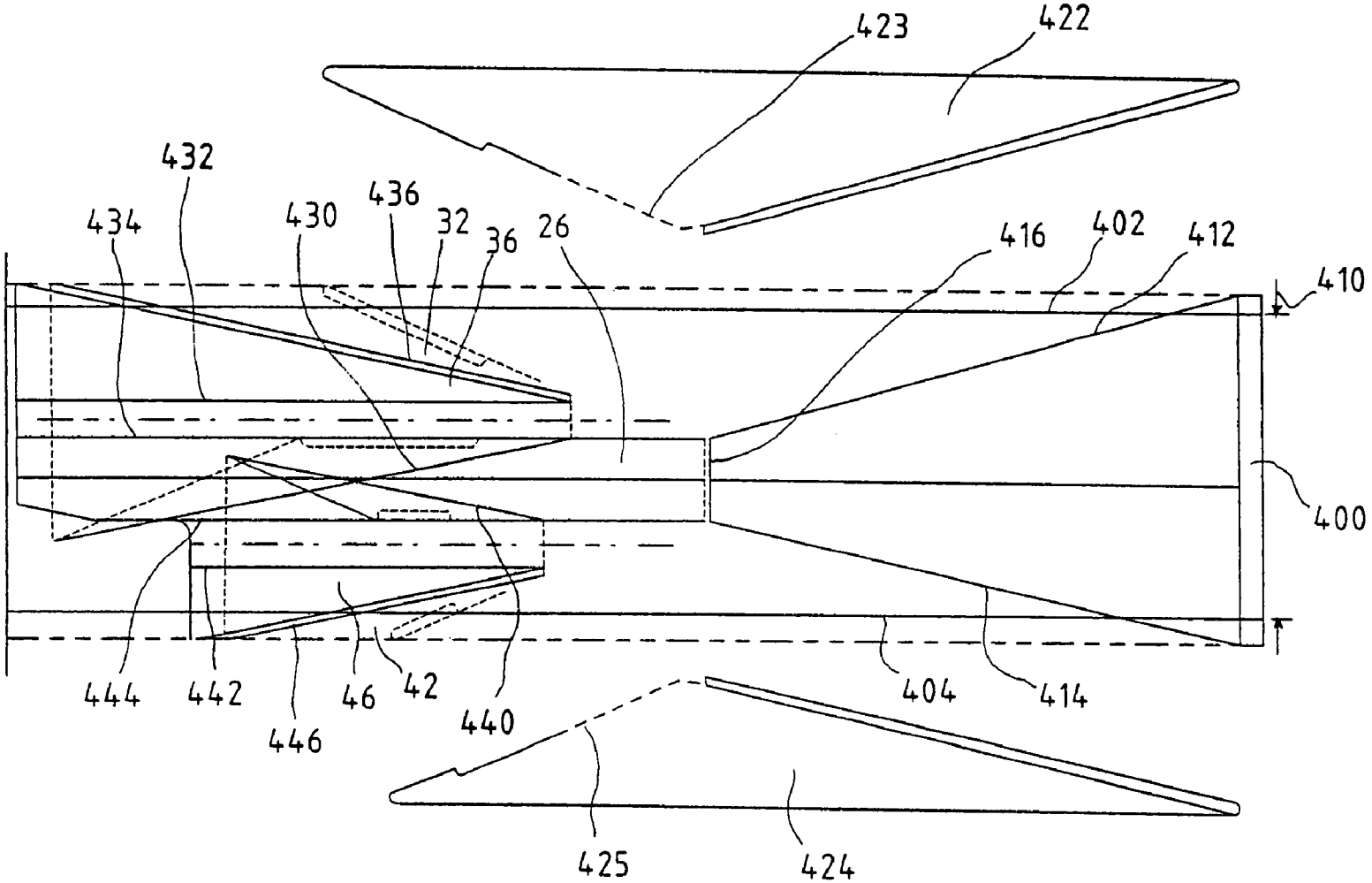
FIG. 11 is a plan view of contact surfaces of the apparatus diagrammatically shown in an unfolded orientation.

More specifically, the contact surfaces of the forming apparatus 10 are selected to have a maximum width approximately the same as the width of the film 400 when the contact surfaces are in a hypothetical unfolded orientation, as diagrammatically illustrated in FIG. 11. The contact surfaces include portions of the continuous entrance surface 50, which includes portions 412 and 414 of the planar entry panels 52 and 54. The portions 412 and 414 of the planar entry panels 52 and 54 are operable connected to the curved side portions 56 and 58. The curved side portions 56 and 58 each have portions 422 and 424 comprising film contact surfaces. Proximate the mouth or entrance 22 of the folding tunnel 20 is a mouth contact surface 416 formed by the intersections of the contact surface portions 412, 414, 422 and 424 of the planar portions 52 and 54, contact surface portions of the curved side portions 56 and 58, and a bottom surface 26 of the folding tunnel 20. Intersecting regions 423 and 425 of the curved side portions have arcuate configurations selected to minimize film stretching as the film enters the mouth 22 of the folding tunnel 20.

The film contact surfaces also include portions of the first and second folding wings 30 and 40. The bottom 26 of the folding tunnel 20 is connected at lateral sides thereof 434 and 444 to arcuate lateral regions 223 and 225 of the folding tunnel 20. The arcuate lateral regions 223 and 225 are connected to the first and second folding wings 30 and 40. The portions of the first and second folding wings 30 and 40 include angled contact edges 430 and 440 (shown in the folded configuration). As partially shown in FIG. 11, these contact edges 430 and 440 have a thickness selected to ensure smooth film flow thereover.

In the unfolded orientation, each of the contact surface, which include the angled contact edges 430 and 440 (identified as 436 and 446 in the unfolded configuration), portions of the first and second folding wings 30 and 40, portions of the continuous entrance surface 50, including the planar panels 52 and 54 and portions 422 and 424 of the curved side panels 56 and 58, and the contact surface portions 26, 223, and 225 of the folding tunnel 20 are at or within the width of the film 400. Thus, the length of the film 400 as its travels across these film contact surfaces in generally constant between the longitudinal side portions 402 and 404 thereof and across the width 410 of the film 400. As discussed above, if the length of the film as it contacts the surfaces of the forming apparatus is generally constant, then the transverse longitudinal tensile forces in the film likewise will also be generally constant.

Figure 16:
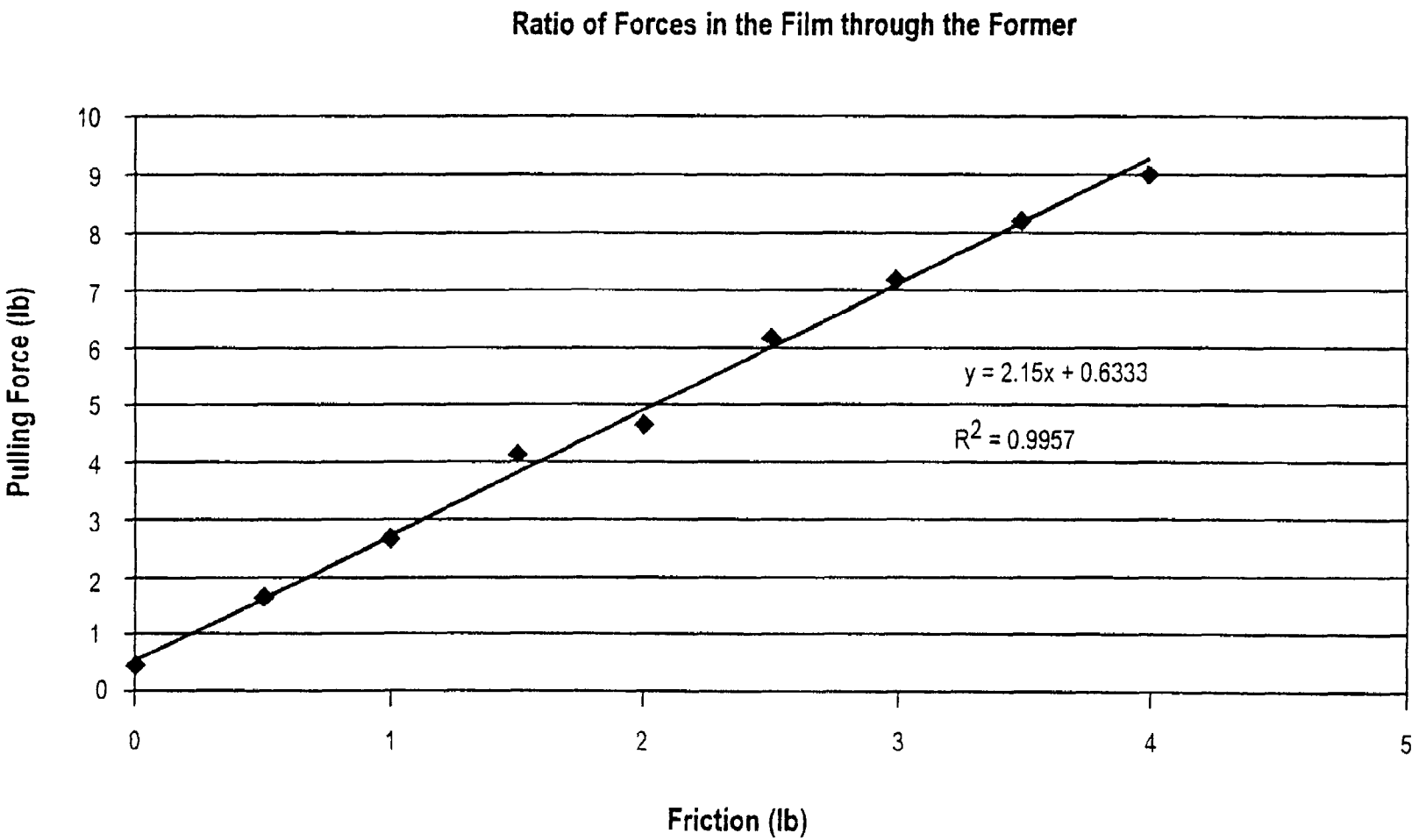
FIG. 16 is a representative chart of the ratio of forces in the film comparing the pulling force on the sleeve and the friction forces acting thereon.
Figure 17:
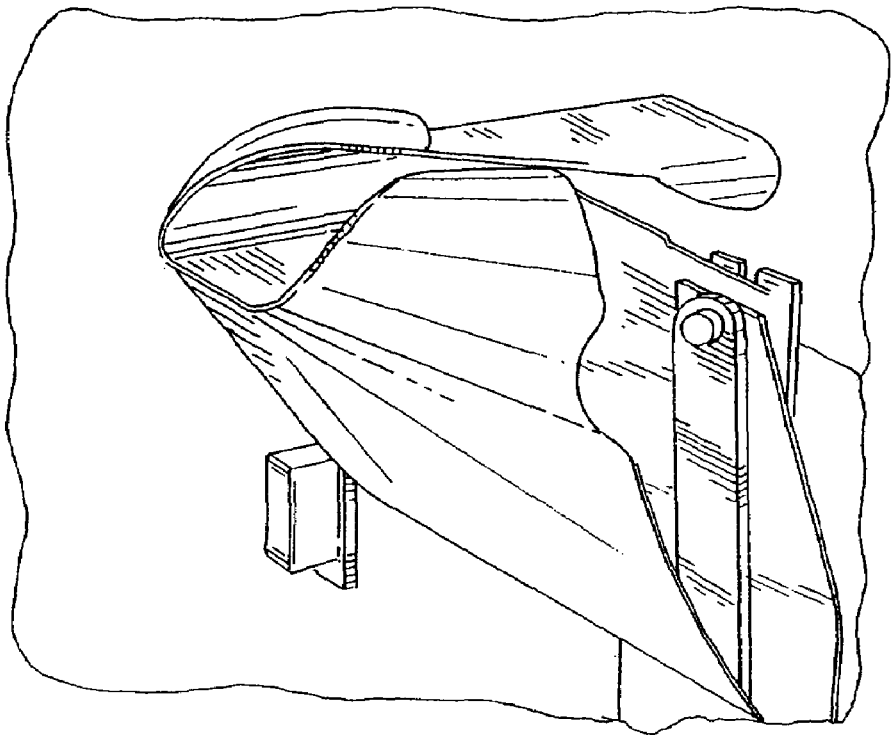
FIG. 17 is a perspective view of a prior art forming apparatus having a separate entrance plate and forming station.

Minimizing the amount of friction force between the film 400 and forming apparatus 10 during movement of the film 400 across contact surfaces of the forming apparatus 10 can result in reduced overall tensions in the film 400, as shown in the chart of FIG. 16. Sources of friction can include various radii of the contact surfaces and variations in the contact surfaces.

To minimize the friction forces, the radii of the contact surfaces are increased. For example, the forming edges 430 and 440 of the first and second folding wings 30 and 40 have radii selected to be between 0.05 and 0.15 inches, which results in a spacing of between about 0.10 and 0.30 inches between outer 32 and 42 and inner 36 and 46 contact surfaces of the first and second folding wings 30 and 40.

To further minimize friction forces, the material used to make the forming apparatus is preferably selected to have a strength sufficient to reduce significant wear. In prior forming systems, such as the prior art integral former of FIGS. 18 and 19, the material used lacked sufficient strength and durability. A result of using a material lacking sufficient strength, in part, can be sharpening of contact edges and other deformations in the contact surfaces. The prior art integral former also had a chrome deposition layer, which due to wear could generate minute but sharp imperfections in the contact surfaces thereof, which could result in tears or other deformations of the film.

To address these friction generating concerns, the material used to make the forming apparatus 10 preferably comprises a stainless steel, and more preferably comprises 17-4PH steel. The steel also is preferably heat-treated after being shaped to ensure sufficient strength. The steel also preferably has a thickness of about 0.125 inches. The strength and thickness of the steel eliminates the need for chrome deposition plating, which providing a strength sufficient to reduce where, thereby minimizing friction forces caused by flaking of chrome plating and wear of the forming apparatus 10. In addition, the use of a thicker material allows for a greater radius to be formed on edges, such as edges 430 and 440 of the folding wings 20 and 40, that comprise contact surfaces with the film 400. Preferably, all edges in contact with the film 400 are machined to give a smooth radius, thereby reducing substantially the possibilities of the film slitting. The welds and other joints between the various components of the forming apparatus 10 and frame assembly 200 are selected and configured in order to reduce gaps or spaces in which bacteria can remain. This assists in ensuring a sterile environment for which the film 400 contacts such surfaces.

Reducing tensions in the film 400 during the forming into a sleeve 401, such as by reducing the ratio of tensile forces in the film 400 at the beginning of the continuous entrance surface 50 and the end of the forming tunnel 20, by configuring contact surface geometry to reduce stretching of the film 400, and by minimizing friction between the film 400 and the forming apparatus 10, can result in the ability to run thinner films therethrough. For example, films having a thickness of less than 0.0014 inches, such as having a thickness of about 0.001 inches, can be run therethrough, and even lower thicknesses approaching 0.0005 inches can be run therethrough. When substantial volumes of sleeves 401 are formed using the film, the savings from the reduced thickness film can be tremendous. Having reduced tensions in the film 400 and smooth forming thereof into a sleeve 401 also permit the film 400 to be fed through the forming apparatus at higher speeds. For example, the forming apparatus can optimally be used to form cheese slices at a rate of about 3,000 slices per minute.

Certain steps are used in order to form steel sheets into the various geometric shapes required for the forming apparatus. These steps include cutting the planar panels 52 and 54, first and second halves 122 and 124 of the folding tunnel 20, and the curved side panels 56 and 58 to the appropriate sizes. The sizes may be determined, in part, by the desired hypothetical unfolded configuration of the contact surfaces, as illustrated in FIG. 11. The first and second halves 122 and 124 of the folding tunnel 20 are folded into their end shapes. Next, the folding tunnel 20 and the panels 52 and 54 are fixed into their final positions using a jig having attachments for these components. The long edges 66 and 68 of the curved side panels 56 and 58 are then attached to the lips 53 and 55 of the planar panels 52 and 54. The jig is then used to apply a bending force to urge the keys 62 and 64 of the into alignment with the locators 63 and 65 on the first and second folding wings 30 and 40 of the folding tunnel 20, thereby bending the panels 56 and 58 into their curved shapes. Welds are made between the joints of each of the components. The welds are polished such that they are generally flush with the adjacent surfaces in order to minimize locations for bacteria and to provide smooth surfaces over which the film 400 can travel.

The forming apparatus 10 may be mounted to a frame support assembly 200 in a horizontal film feed orientation. The frame support assembly 200 may include a longitudinally extending support arm 202 having a connection 210 at one end 204 for the filling tube 90 and at the other end 206 for the forming apparatus 10. Having the filling tube 90 and the forming apparatus 10 connected to a common support arm 202 advantageously provides assistance in aligning the filling tube 90 within the forming tunnel 20. The filling tube 90 extends through the folding tunnel 20, as illustrated in FIG. 9. The outer surfaces of the filling tube 90 and the inner surfaces of the folding tunnel 20 are sized such that there is a small space therebetween in order to allow the film 400 to be wrapped around the filling tube 90 by the folding tunnel 20.

Figure 12:
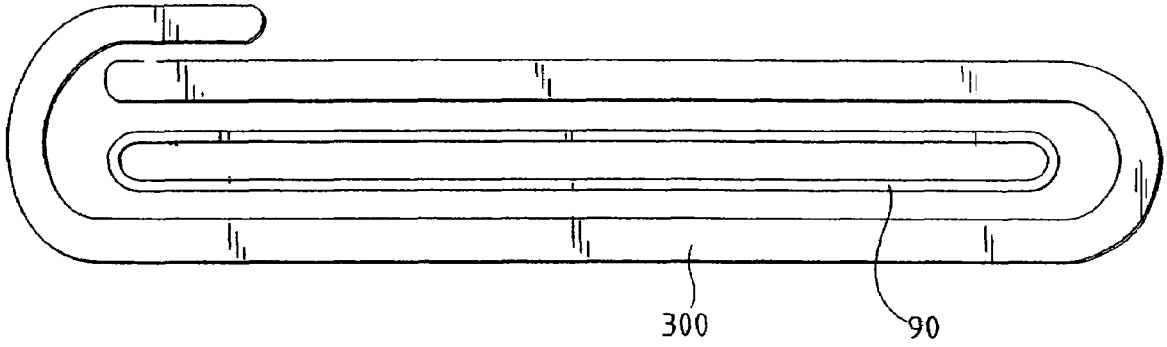
FIG. 12 is an end view representation of the apparatus having the filling tube therein.

The filling tube 90 has a connection 92 at one end for a product, such as cheese, to be pumped therethrough and through the folding tunnel 20 and out the exit 24 and into the sleeve 401 formed by the folding tunnel 20. A release mechanism 212 may be provided between the connection 210 and the filling tube 90 to allow the filling tube 90 to be removed from the frame assembly 200, such as to permit cleaning. The high forces due to the pumping of the product through the filling tube 90 are at least partially transferred by the common support arm 202 to the folding tunnel 20 to ensure that the space between the outer surfaces of the filling tube 90 and the inner surfaces of the folding tunnel 20 remains relatively constant. The connection mechanism 210 may also be adjustable to allow for precise positioning of the filling tube 90 within the tunnel 20. Pinching of the film 400 between the outer surfaces of the filling tube 90 and the inner surfaces of the folding tunnel 20 can be reduced by having a stable connection between the filling tube 90 and the folding tunnel 20. Moreover, the sectional profile of the folding tunnel 20 can be closely matched to the sectional profile of the filling tube 90 in order to assist in forming a sleeve 401 closely sized to the product exiting the filling tube 20, as shown in FIG. 12.

Figure 13:
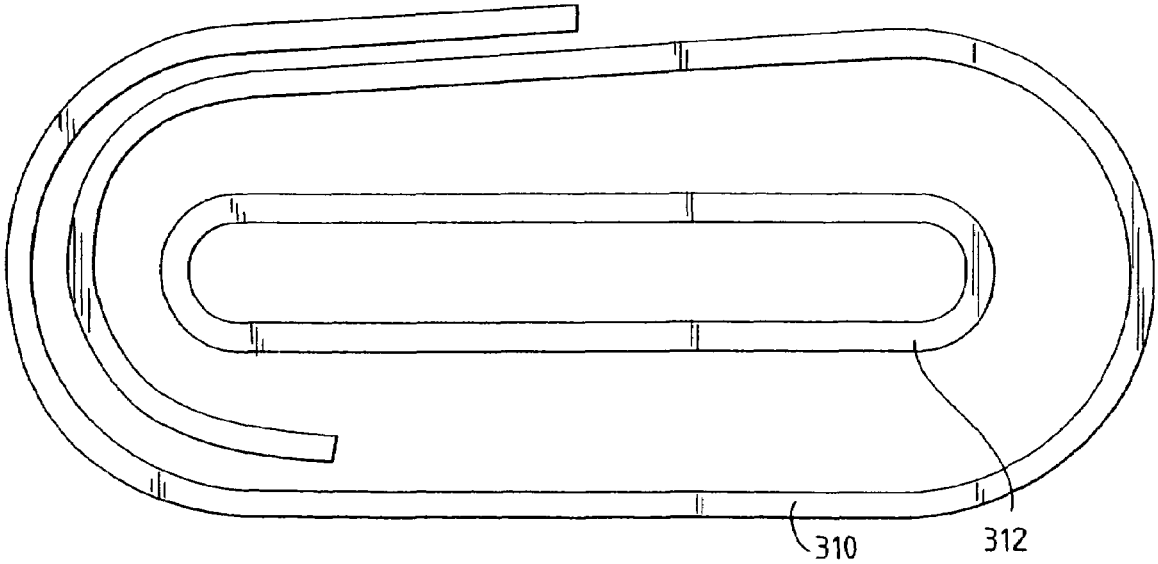
Fig. 13 PRIOR ART
FIG. 13 is an end view representation of a prior art forming apparatus having a filling tube therein.
Figure 14:
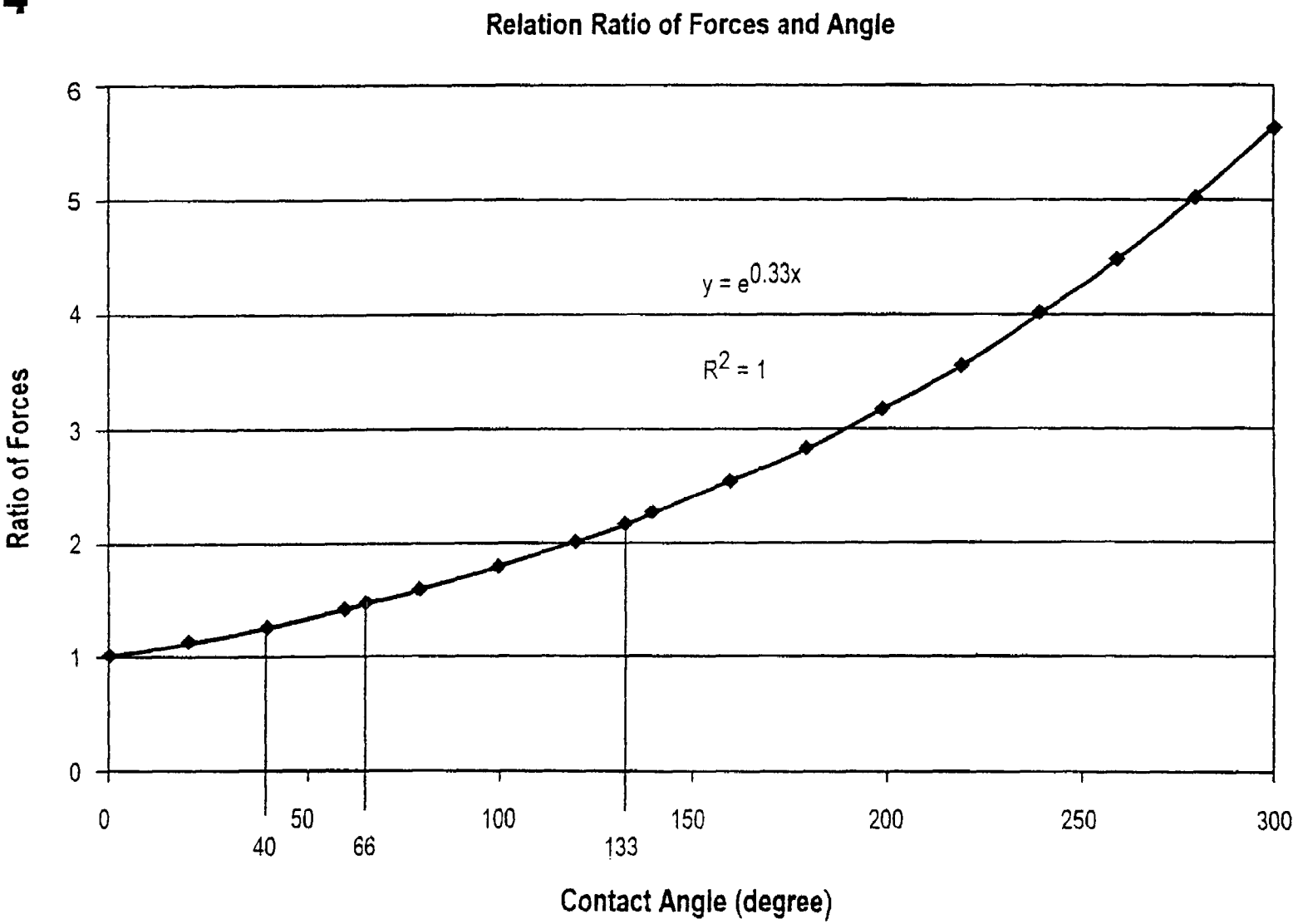
FIG. 14 is a representative chart comparing the relation of the tension force ratio between the tension force in the film at a beginning of a continuous entrance surface and the tension force in the film at an exit of a folding tunnel and an angle between the continuous entrance surface and a longitudinal axis of the folding tunnel.

Shaping the cross-section of the filling tube 90 closely to that of the cross-section of the folding tunnel 20 also can result in better control over the slice width and behavior when the apparatus 10 is used to produce individually wrapped slices of cheese or other products. The folding tunnel 20 and folding wings 30 and 40 may be configured to have minimal overlap between the longitudinal edges 402 and 404 of the film 400. By comparison, the prior art integral forming apparatus required much more space between the inner surfaces of its former and the outer surfaces of its filling tube, as shown in FIG. 13, in order to provide sufficient tolerance for relative movement therebetween. Moreover, the prior former of FIG. 13 resulted in a significant overlap of film lateral edges.

The common support arm 202 is attached to a pivot arm 208. The pivot arm 208 extends downward from the common support arm 202 to a pivot 210. The pivot 210 is positioned between a bracket arm 214 and the downwardly extending pivot arm 208. The pivot 210 allows the common support member 202 and pivot arm 208 to pivot and rotate the forming apparatus 10 attached thereto between an upper position and a lower position. When in the lower position, the forming apparatus 10 is removed a sufficient distance in order to allow access to a second forming apparatus 100 that may be mounted therebehind. The second forming apparatus 100 is similar to the first forming apparatus 10, having a folding tunnel 120, first and second folding wings 130 and 140, and a continuous entrance surface 150. The pivoting of the first forming apparatus 10 can advantageously allow increased accessibility to the second forming apparatus 100, such as for cleaning and feeding of film therethrough manually. The bracket arm 214 is attached to multiple arms that form the remainder of the frame assembly 200.

The frame 200 includes four bolts for securing the assembly, including the first and second forming apparatus 10 and 100, to other machinery. Shims 221 are provided adjacent the bolts in order to allow for adjustments to be made in the orientation of the forming apparatus 10 and 100 and frame assembly 200 relative to the other machinery. For example, different thicknesses of shims 221 can be used to more precisely control the position of the frame 220. In addition, shims 222 may also be used to control the relative position of the first forming apparatus 10 to the common support arm 202, as illustrated in FIG. 10. Shims may also be used to control the relative position of the second forming apparatus relative to the frame 200.

The method and apparatus 10 described above is useful in high speed commercial operations such as a continuous "hot pack" line wherein individually wrapped cheese slices are formed, such as by filling the sleeve 401 with cheese using the filling tube 90, separated, and stacked (such as using the apparatus and methods disclosed in U.S. Pat. No. 6,595,739, the disclosure of which is hereby incorporated by reference in its entirety), and an overwrap is then formed, filled, and sealed around the stack, in a continuous, in line operation. In this type of process, the cheese slice may comprise a slice of pasteurized process cheese, pasteurized process cheese food, pasteurized process cheese spread, or the like, hot filled into the continuous sleeve to form a ribbon which is separated into individual wrapped slices. The method and apparatus of the invention may also be useful with other foods, such as slices of meat or natural cheese.

As can be appreciated from the above description of FIGS. 1-20, there is provided a new forming apparatus for forming a film into a sleeve around a filling tube, which has contact surface geometry configured to ensure smooth forming of the film into the sleeve, in part by reducing longitudinal tensile forces in the film. While there have been illustrated and described particular embodiments, it will be appreciated that numerous changes and modifications will occur to those skilled in the art, and it is intended in the appended claims to cover all those changes and modifications which fall within the true spirit and scope thereof.

The invention claimed is:

1. An apparatus for forming a film into a sleeve around a filling tube, the apparatus comprising:

a continuous film entrance surface operably connected to an entrance of a folding tunnel, the folding tunnel having a longitudinal axis including an upstream extension extending in an upstream direction from the entrance, at least a portion of the entrance surface positioned to lead into the folding tunnel being inclined at an acute angle relative to the upstream extension of the longitudinal axis of the folding tunnel spaced from the folding tunnel;

a first folding wing of the folding tunnel positioned for folding a first longitudinal side portion of the film at least partially around the filling tunnel;

a second folding wing of the folding tunnel positioned for folding a second longitudinal side portion of the film, disposed opposite the first longitudinal side portion of the film, at least partially around the filling tunnel and overlapping at least a portion of the first longitudinal side portion of the film to form the sleeve.

2. An apparatus for forming a film into a sleeve around a filling tube, the apparatus comprising:

a continuous film entrance surface operably connected to an entrance of a folding tunnel, the folding tunnel having a longitudinal axis including an upstream extension extending in an upstream direction from the entrance, at least a portion of the entrance surface positioned to lead into the folding tunnel being inclined at an acute angle relative to the upstream extension of the longitudinal axis of the folding tunnel to form a film path from the continuous entrance surface to the folding tunnel having a change in its direction of travel of an acute angle;

a first folding wing of the folding tunnel positioned for folding a first longitudinal side portion of the film at least partially around the filling tunnel;

a second folding wing of the folding tunnel positioned for folding a second longitudinal side portion of the film, disposed opposite the first longitudinal side portion of the film, at least partially around the filling tunnel and overlapping at least a portion of the first longitudinal side portion of the film to form the sleeve.

3. An apparatus for forming a film into a sleeve around a filling tube in accordance with claim 2, wherein the continuous film entrance surface comprises a generally planar central portion positioned between a pair of curved side portions.

4. An apparatus for forming a film into a sleeve around a filling tube in accordance with claim 3, wherein the curved side portions of the continuous film entrance surface are each connected to one of the first and second folding wings.

5. An apparatus for forming a film into a sleeve around a filling tube in accordance with claim 2, wherein the acute angle between the portion of the entrance surface and the upstream extension of the longitudinal axis of the folding tunnel is selected to have the ratio of forces on the film before the continuous film entrance and after the folding tunnel be between 1:1 and 2:1.

6. An apparatus for forming a film into a sleeve around a filling tube in accordance with claim 2, wherein the acute angle between the portion of the entrance surface and the folding tunnel is between 40 degrees and 90 degrees.

7. An apparatus for forming a film into a sleeve around a filling tube in accordance with claim 2, wherein each of the first and second folding wings includes a folding wing contact edge being arcuate and having a radius of between 0.05 and 0.15 inches, each folding wing contact edge being positioned at an acute angle relative to a longitudinal axis of the folding tunnel.

8. An apparatus for forming a film into a sleeve around a filling tube in accordance with claim 2, wherein film contact surfaces of the continuous film entrance surface, the first and second folding wings, and the folding tunnel are selected to maintain a generally constant length of the film between a beginning of the continuous film entrance and the end of the folding tunnel in the film feed direction.

9. An apparatus for forming film into a sleeve around a filling tube in accordance with claim 8, wherein a maximum transverse width of the contact surfaces of the folding tunnel and first and second folding wings in an unfolded configuration of the folding tunnel is approximately the same as a transverse width of the film.

10. An apparatus for forming film into a sleeve around a filling tube in accordance with claim 9, wherein the apparatus is formed of material approximately 0.125 inches thick.

11. An apparatus for forming film into a sleeve around a filling tube in accordance with claim 10, wherein material comprises stainless steel 17-4PH and the contact surfaces of the apparatus are free of plating.

* * * * *